US006025552A

United States Patent [19]

Mukaino et al.

[11] Patent Number: 6,025,552

[45] Date of Patent: Feb. 15, 2000

[54] COMPUTERIZED MUSIC APPARATUS PROCESSING WAVEFORM TO CREATE SOUND EFFECT, A METHOD OF OPERATING SUCH AN APPARATUS, AND A MACHINE-READABLE MEDIA

[75] Inventors: Hirofumi Mukaino; Takeshi Mori, both of Hamamatsu, Japan

[73] Assignee: Yamaha Corporation, Hamamatsu, Japan

[21] Appl. No.: 08/716,552

[22] Filed: Sep. 18, 1996

[30] Foreign Application Priority Data

Sep. 20, 1995 [JP] Japan ..... 7-266252
Sep. 20, 1995 [JP] Japan ..... 7-266253

[51] Int. Cl.[7] ..... G10H 7/00
[52] U.S. Cl. ..... 84/605
[58] Field of Search ..... 84/600, 603–605, 84/661

[56] References Cited

U.S. PATENT DOCUMENTS

| | | | |
|---|---|---|---|
| 4,373,416 | 2/1983 | Endo et al. . | |
| 4,961,363 | 10/1990 | Mizuno et al. . | |
| 5,160,799 | 11/1992 | Tozuka et al. . | |
| 5,200,564 | 4/1993 | Usami et al. . | |
| 5,239,123 | 8/1993 | Fujita . | |
| 5,278,350 | 1/1994 | Okamoto et al. . | |
| 5,283,386 | 2/1994 | Akutsu et al. . | |
| 5,308,916 | 5/1994 | Murata et al. | 84/603 |

(List continued on next page.)

FOREIGN PATENT DOCUMENTS

| | | |
|---|---|---|
| 63-289592 | 11/1988 | Japan . |
| 4-51196 | 2/1992 | Japan . |
| 5-216476 | 8/1993 | Japan . |
| 5-313667 | 11/1993 | Japan . |
| 6-124091 | 6/1994 | Japan . |
| 7-175477 | 7/1995 | Japan . |
| WO 80/01215 | 6/1980 | WIPO . |

OTHER PUBLICATIONS

"Digidesign Turbosynth: Synthesis and Sound Processing for the Apple Macintosh," Computer Music Journal, vol. 12, No. 3, Fall 1988, pp. 79–80.

(List continued on next page.)

*Primary Examiner*—William M. Shoop, Jr.
*Assistant Examiner*—Jeffrey W. Donels
*Attorney, Agent, or Firm*—Graham & James LLP

[57] ABSTRACT

A computerized music apparatus is installed with a program which is executed to perform reproduction of a musical tone by reading out a corresponding waveform. A storage is provided for storing a plurality of waveforms corresponding to different musical tones, each waveform being stored in the form of a sequence of amplitude value data arranged at a given sampling period. Tapping pads are provided for designating at least one of the stored waveforms to command reproduction of a corresponding one of the musical tones. A panel switch is operable by a user for switching the reproduction of the musical tone between a normal mode and an optional mode. A CPU is allotted with relatively high performance under the normal mode for concurrently reading out a number of the designated waveforms from the storage according to the program so as to concurrently reproduce the number of the corresponding musical tones. Otherwise, the CPU is allotted with relatively low performance under the optional mode such that the number of the musical tones concurrently reproduced under the optional mode is reduced as compared to that under the normal mode while the CPU is allotted with additional performance under the optional mode for digitally processing the designated waveform to impart a scratch effect to the reproduced musical tone according to the program. The scratch effect may be also applied to a fresh waveform inputted from an external source in real time.

61 Claims, 17 Drawing Sheets

U.S. PATENT DOCUMENTS

| | | | |
|---|---|---|---|
| 5,319,151 | 6/1994 | Shiba et al. . | |
| 5,350,882 | 9/1994 | Koguchi . | |
| 5,432,293 | 7/1995 | Nonaka et al. . | |
| 5,512,704 | 4/1996 | Adachi . | |
| 5,554,814 | 9/1996 | Nakata . | |
| 5,596,159 | 1/1997 | O'Connell | 84/622 |
| 5,726,371 | 3/1998 | Shiba et al. . | |

OTHER PUBLICATIONS

"Accelerando: A Real–Time, General Purpose Computer Music System," by Keith Lent, et al, Computer Music Journal, vol. 13, No. 4, Winter, 1989, pp. 54–64.

"Digidesign's Sound Accelerator: Lessons Lived and Learned," by Bill Lowe and Robert Currie, Computer Music Journal, vol. 13, No. 1, Spring 1989, pp. 36–46.

"Musical Applications of Microprocessors", Second Edition, by Hal Chamberlin, 1985, pp. 639–778.

COMPUTERIZED MUSIC APPARATUS PROCESSING WAVEFORM TO CREATE SOUND EFFECT, A METHOD OF OPERATING SUCH AN APPARATUS, AND A MACHINE-READABLE MEDIA

BACKGROUND OF THE INVENTION

The present invention relates to a musical tone generating apparatus for reading out waveform data stored in a digital memory to generate a musical tone using the software. The present invention also relates to a musical tone generating apparatus for processing waveform data inputted in real time using the software. In particular, the invention relates to a musical tone generating apparatus capable of applying a filter process, a pitch process or a scratch process to the generated musical tones while a number of the musical tones is reduced as compared to normal generation or reproduction of the musical tones. Further, the present invention relates to a musical tone generating apparatus capable of achieving a scratch effect in a pseudo fashion.

A software sound source has been known, wherein waveform data sampled from original musical tones is stored in a storage device in advance. The stored waveform data is read out by a software or program in response to operation of a manual implement. However, the conventional software sound source is functionally fixed and therefore has rather limited applications and poor performance. In recent years, a high performance sound source has been demanded, which can impart various effects such as a digital tone color filter process and a scratch effect to a musical tone. Scratch is originally a technique for producing a special effect tone by forcibly moving an analog record disk by hand while the record disk is driven on a turntable, so as to change a replaying speed irregularly. Conventionally, an analog record disk is used to impart the scratch effect. There has been no digital musical tone generating apparatus which realizes such a scratch effect.

SUMMARY OF THE INVENTION

In a musical tone generating apparatus which reads out waveform data stored in a digital memory to generate musical tones using software, an object of the present invention is to achieve extended performance which could not be realized by the conventional software sound source so as to apply various processes and effects to the musical tones while the number of the generated musical tones may be saved. Further, in a musical tone generating apparatus which directly outputs waveform data inputted in real time, an object of the present invention is to achieve high performance which could not be realized by the conventional software sound source so as to apply various processes and effects to the externally inputted waveform data. Moreover, it is an object of the present invention to realize a scratch effect in a pseudo fashion in a musical tone generating apparatus which reads out waveform data stored in a digital memory or which directly outputs waveform data inputted in real time.

According to a first aspect of the invention, a computerized music apparatus is installed with a program which is executed to perform reproduction of a musical tone by reading out a corresponding waveform. The computerized music apparatus comprises storage means for storing a plurality of waveforms corresponding to different musical tones, each waveform being stored in the form of a sequence of amplitude value data arranged at a given sampling period, designating means for designating at least one of the stored waveforms to command reproduction of a corresponding one of the musical tones, switching means operable by a user for switching the reproduction of the musical tone between a normal mode and an optional mode, and reproducing means allotted with relatively high performance under the normal mode for concurrently reading out a number of the designated waveforms from the storage means according to the program so as to concurrently reproduce the number of the corresponding musical tones, otherwise the reproducing means being allotted with relatively low performance under the optional mode such that the number of the musical tones concurrently reproduced under the optional mode is reduced as compared to that under the normal mode while the reproducing means is allotted with additional performance under the optional mode for digitally processing the designated waveform to impart a specific sound effect to the reproduced musical tone according to the program.

In a specific form, the switching means comprises means switchable between the normal mode and a filter optional mode such that the reproducing means operates under the filter optional mode for digitally processing the designated waveform by filtering to impart the specific sound effect such as to modify a timbre of the reproduced musical tone. In another specific form, the switching means comprises means switchable between the normal mode and a pitch optional mode such that the reproducing means operates under the pitch optional mode for digitally processing the designated waveform by changing reading speed of the designated waveform to impart the specific sound effect such as to modify a pitch of the reproduced musical tone. In such a case, the computerized music apparatus further includes pitch specifying means operable by the user for specifying a pitch of a musical tone to be reproduced so that the reproducing means operates under the pitch optional mode to impart the pitch specified by the pitch specifying means to the reproduced musical tone. Moreover, the designating means and the pitch specifying means comprise a common implement manually operable by the user such that the common implement is used as the designating means for designating the waveform under the normal mode while the common implement is used as both of the designating means for designating the waveform and the pitch specifying means for specifying the pitch of the musical tone corresponding to the designated waveform.

In a further specific form, the switching means comprises means switchable between the normal mode and a scratch optional mode such that the reproducing means operates under the scratch optional mode for digitally processing the designated waveform by irregularly changing reading addresses of the designated waveform to impart the specific sound effect such as to scratch the corresponding musical tone. In such a case, the computerized music apparatus further comprises a scratch implement manipulated by the user to input scratch operation so that the reproducing means operates under the scratch optional mode for changing the reading addresses of the designated waveform according to the inputted scratch operation.

In a second aspect of the invention, a computerized music apparatus is installed with a program which is executed to perform reproduction of a musical tone by reading out a corresponding waveform. The computerized music apparatus comprises storage means for provisionally storing a plurality of waveforms corresponding to different musical tones, each waveform being stored in the form of a sequence of amplitude value data arranged at a given sampling period, designating means for designating at least one of the stored waveforms to command reproduction of a corresponding one of the musical tones, receiving means for receiving a fresh waveform in real time basis when the fresh waveform is inputted from an external source, switching means operable by a user for switching the reproduction of the musical tone between a normal mode and an optional mode, and reproducing means operative under the normal mode for reading out the stored waveform designated by the designating means from the storage means according to the program so as to reproduce the musical tone corresponding to the designated waveform, otherwise the reproducing means being operative under the optional mode for suspending or stopping the reading of the stored waveform designated by the designating means and instead for processing the fresh waveform received by the receiving means so as to reproduce the musical tone corresponding to the fresh waveform such that a specific sound effect is imparted to the reproduced musical tone according to the program. In a specific form, the reproducing means includes filtering means operative under the optional mode for processing the fresh waveform by digital filtering to thereby impart the specific sound effect such as to modify a timbre of the reproduced musical tone. In another specific form, the reproducing means includes scratching means operative under the optional mode for irregularly processing the fresh waveform to thereby impart the specific sound effect such as to scratch the reproduced musical tone. In such a case, the computerized music apparatus further comprises a scratch implement manipulated by the user to input scratch operation so that the scratching means operates according to the inputted scratch operation for irregularly changing reading addresses of the fresh waveform which is temporarily stored after the same is received by the receiving means to thereby scratch the reproduced musical tone.

In a third aspect of the invention, a music apparatus reproduces a musical tone by reading out a corresponding waveform according to a variable reading address so as to introduce a scratch effect into the reproduced musical tone in response to touch action. The musical apparatus comprises storage means for storing a waveform in the form of a sequence of amplitude value data arranged at a given sampling period to represent a corresponding musical tone, a detecting implement having a length to receive the touch action for detecting a point of the touch action along the length and for outputting a positional value corresponding to the detected point of the touch action, retrieving means for periodically retrieving the positional value outputted from the detecting implement to monitor the touch action, and reproducing means for variably determining each reading address according to the retrieved ones of the positional values and for successively reading out the waveform from the storage means according to each determined reading address so as to reproduce the corresponding musical tone with the scratch effect. Characterizingly, the reproducing means comprises means operative when the touch action is initiated for starting to read out the waveform from a predetermined start reading address, and being operative during the course of the touch action for continuing to successively read out the waveform according to each determined reading address. Further, the retrieving means comprises means for differentially processing the periodically retrieved positional values to compute a velocity of the touch action, and the reproducing means comprises means for determining a variable number according to the velocity of the touch action and for accumulating the variable number to a preceding reading address to determine a succeeding reading address. Moreover, the storage means comprises means for storing a waveform which is inputted from an external source in real time basis, and the reproducing means comprises means operative when the touch action is not commenced for outputting the inputted waveform as it is to reproduce the corresponding musical tone without the scratch effect, and being operative when the touch action is commenced for stopping the storing and outputting of the waveform and instead for successively reading out the waveform from the storage means according to the variable reading addresses to reproduce the corresponding musical tone with the scratch effect. Preferably, the storage means has a memory capacity sufficient to store a complete data volume of a fresh waveform newly inputted from the external source on a real time basis.

DETAILED DESCRIPTION OF THE INVENTION

Figure 1:
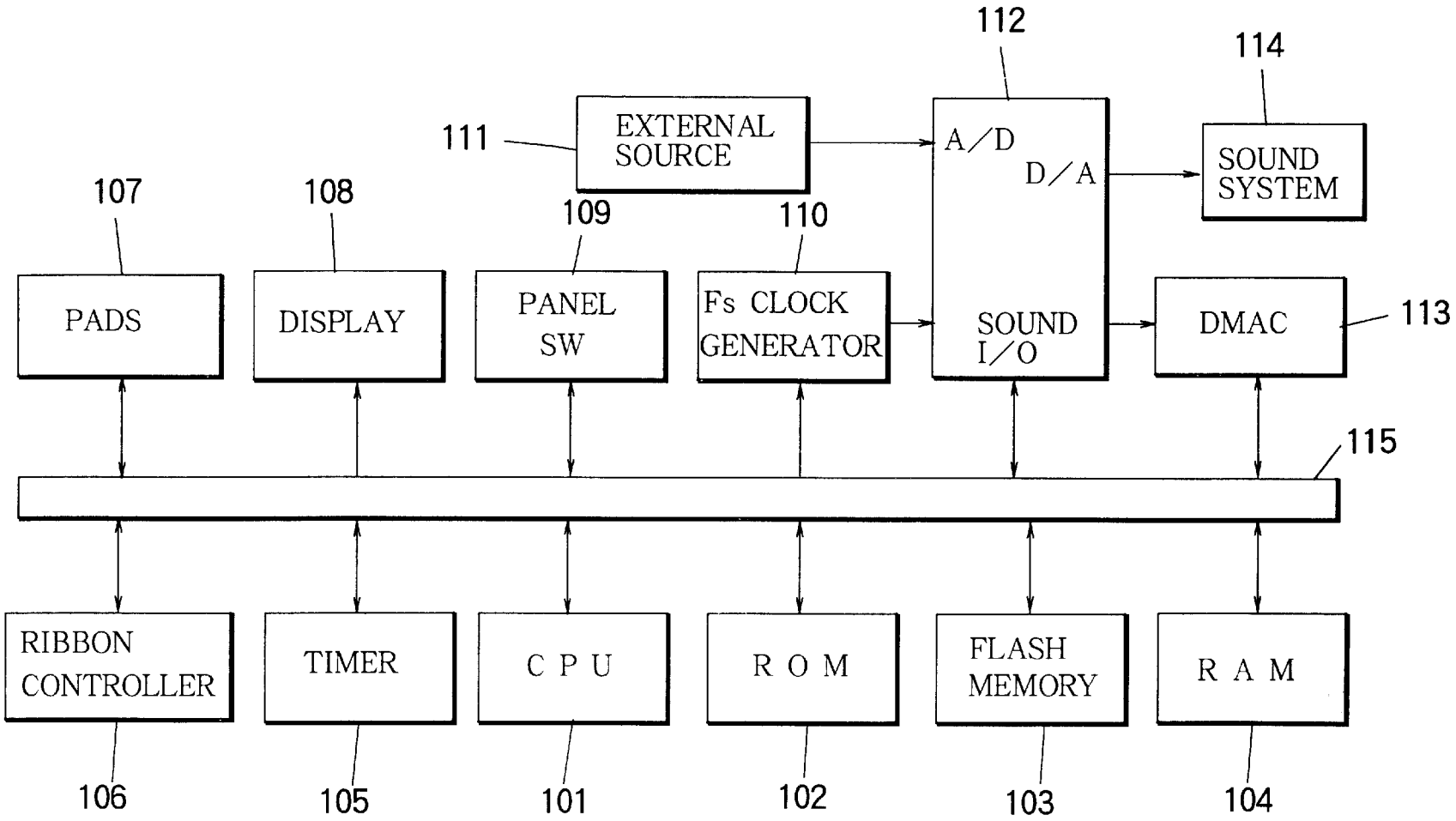
FIG. 1 is a structural block diagram of a sampler as an embodiment of a musical tone generating apparatus according to the present invention.

Hereinbelow, embodiments of the present invention will be described with reference to the drawings. FIG. 1 is a structural block diagram of a sampler which is an embodiment of a musical tone generating apparatus according to the present invention. The sampler includes a central processing unit (CPU) 101, a read only memory (ROM) 102, a flash memory 103, a random access memory (RAM) 104, a timer 105, a ribbon controller 106, a set of operating pads 107, a display 108, a panel switch 109, a sampling clock (Fs)

generator 110, a sound I/O 112, a DMA (direct memory access) controller 113, and a bus line 115.

The CPU 101 controls operation of the whole system of the sampler. The ROM 102 stores control programs executed by the CPU 101. The RAM 104 is provided with working areas such as various registers and buffers. The flash memory 103 is a memory for storing waveform data sampled and recorded by this sampler. The recorded waveform data is temporarily stored in a recording buffer on the RAM 104. When the recording buffer is filled up, the waveform data in the recording buffer is transferred to the flash memory 103. Even if the sampler is powered off, the waveform data in the flash memory 103 is held. Thus, the sampler has storage means for storing a plurality of waveforms corresponding to different musical tones. Each waveform is stored in the form of a sequence of amplitude value data arranged at a given sampling period to represent the corresponding musical tone.

The timer 105 generates a timer clock signal for causing a timer interruption at a given time interval to the CPU 101. By means of the timer interruption, the CPU 101 executes various processes such as retrieving a detection value of the ribbon controller 106 at a given time interval.

The ribbon controller 106 is an operating implement manipulated by a user to perform scratch operation. The ribbon controller 106 is a coordinate detecting device which has a linear member of a finite length and which outputs a coordinate of a position where a finger or a rod touches the linear member. The ribbon controller 106 features that its operation can be commenced at an arbitrary position. The ribbon controller 106 outputs a default value while no touch action with the finger or the rod occurs, and otherwise outputs a coordinate position value when the touch action occurs. Thus, it can be determined from the detection value whether the ribbon controller 106 is operated or not, that is, whether the touch action with the finger or the rod occurs or not. Namely, the detecting implement has a length to receive the touch action for detecting a point of the touch action along the length and for outputting a positional value corresponding to the detected point of the touch action.

The pads 107 constitute another operating implement manipulated by the user to control the tone generation. Specifically, a set of the ten pads 107 are provided. The recording or sampling of an original musical tone can be achieved by designating one of the ten pads 107. In reproduction of the recorded tones, a particular one of the pads 107 is tapped by the user so that the waveform data recorded corresponding to that pad is read out and replayed. Instead of tapping or setting on the pad, it may be arranged to perform the tone reproduction by receiving note-on data of a MIDI (musical instrument digital interface) signal. The pads 107 constitute designating means for designating at least one of the stored waveforms to command reproduction of a corresponding one of the musical tones.

The display 108 is provided for displaying various setting information. The panel switch (SW) 109 is a switch group provided on a panel of the sampler for the user to perform various setting operations. The panel switch 109 includes various switches such as a mode change-over switch which constitutes switching means for switching the tone reproduction between a normal mode and one of various optional modes.

The Fs clock generator 110 generates a sampling clock of a frequency Fs fed to the sound I/O 112. The sound I/O 112 is constituted by an LSI called CODEC. The sound I/O 112 has an analog-to-digital (A/D) conversion function and a digital-to-analog (D/A) conversion function. The sound I/O 112 has an A/D input terminal at which an analog musical tone signal inputted from an external source 111 is received, and a D/A output terminal to which a sound system 114 is connected. The sound I/O 112 has a function of compressing waveform data which is obtained by converting the received analog musical tone signal from the external source 111 into digital data through the A/D conversion function. The waveform data is compressed according to the ADPCM (adaptive differential pulse code modulation). Further, the sound I/O 112 has another function of performing ADPCM expansion to the waveform data which is D/A converted and outputted to the sound system 114 through the D/A output terminal. In the embodiment of the invention explained here, only the ADPCM compression is actually performed at the sound I/O 112, and the ADPCM expansion is performed by execution of a given software by the CPU 101.

The sound I/O 112 is provided therein with two FIFO (first in first out) stack regions. One of them is an input FIFO for holding digital waveform data inputted via the A/D input terminal, and the other is an output FIFO for holding digital waveform data outputted via the D/A output terminal. The sound I/O 112 constitutes receiving means for receiving a fresh waveform in real time basis when the same is inputted from the external source 111.

Hereinbelow, input/output operations of the sound I/O 112 using the input FIFO and the output FIFO will be briefly explained. An analog musical tone signal inputted to the A/D input terminal of the sound I/O 112 from the external source 111 is A/D converted in response to the sampling clock of the frequency Fs, and is then written into the input FIFO (ADPCM compressed if necessary). When the waveform data exists in the input FIFO, the sound I/O 112 outputs a demand for processing the input waveform data to the DMA controller 113. In response to the process demand, the DMA controller 113 transfers the data of the input FIFO to a recording buffer region prepared in the RAM 104. This data transfer by the DMA controller 113 is performed such that the DMA controller 113 executes an interruption operation relative to the CPU 101 every sampling clock Fs so as to hold the bus line 115. The CPU 101 is unconscious of the holding of the bus line 115 by the DMA controller 113. The foregoing transfer process of the waveform data by the DMA controller 113 during the recording of the musical tone will be described later in detail with reference to FIG. 15.

On the other hand, when the waveform data exists in the output FIFO of the sound I/O 112, the waveform data in the output FIFO is D/A converted every sampling clock Fs, and is sent to the sound system 114 via the D/A output terminal so that the musical tone is emitted. When the waveform data of the output FIFO is outputted, there is a room in the output FIFO so that the sound I/O 112 outputs a demand for obtaining another waveform data to the DMA controller 113. The CPU 101 generates in advance waveform data to be outputted, then stores the generated waveform data in a reproduction buffer on the RAM 104, and outputs in advance a demand for reproducing the waveform data to the DMA controller 113. The DMA controller 113 executes an interruption operation every sampling clock Fs relative to the CPU 101 so as to hold the bus line 115 and transfers the waveform data stored in the reproduction buffer of the RAM 104 to the sound I/O 112. The CPU 101 is unconscious of the transfer of the waveform data by the DMA controller 113. The waveform data written in the output FIFO is, as described above, sent to the sound system 114 every sampling clock Fs so that the musical tone is emitted. The foregoing transfer process of the waveform data by the DMA controller 113 during the tone reproduction will be described later in detail with reference to FIG. 16.

Further, the sound I/O 112 has a function to directly transfer the waveform data inputted at the A/D input terminal to the D/A output terminal so that the musical tone signal from the external source 111 is directly outputted to the sound system 114 as it is. Connection between the A/D input and the D/A output is performed based on an instruction from the CPU 101. Further, the CPU 101 is capable of cutting the direct connection between the A/D input and the D/A output.

Next, basic operation of the sampler of FIG. 1 will be briefly explained. The sampler has seven operation modes, that is, a normal mode, a sampling mode and five optional modes including a filter mode, a pitch mode, a scratch mode, an external input (EX) filter mode, and an external input (EX) scratch mode. These modes can be switched by means of the mode change-over switch provided in the panel switch 109. Hereinbelow, each mode will be explained.

The normal mode is selected for replaying the recorded musical tone. In an initial state, the sampler is set the normal mode. In the normal mode, when the user taps one of the ten pads 107, the waveform data recorded corresponding to that pad is read out from the storage by reproducing means composed of the CPU 101 according to an installed program. In the normal mode, up to four tones can be reproduced concurrently. Specifically, four waveform data recorded corresponding to the tapped four pads are replayed simultaneously. When the fifth pad is tapped, the reproduced tone corresponding to the pad first tapped is stopped and the waveform data corresponding to the newly tapped fifth pad is replayed.

The sampling mode is selected for recording a fresh waveform. When the sampling mode is designated using the mode change-over switch, the user simultaneously designates a pad for recording. By this, the musical tone inputted from the external source 111 can be recorded corresponding to that designated pad.

In the filter optional mode, only two tones can be reproduced concurrently according to pad-on in contrast to the normal mode. Namely, the reproducing means is allotted with high performance under the normal mode for concurrently reading out at most four number of waveforms, and is allotted with low performance in the optional mode such as the filter mode for concurrently reading out at most two number of waveforms. Further, digital filter processing, specifically, low-pass filter processing is applied to those reproduced tones. By operating the ribbon controller 106, the user can change a cut-off frequency in the low-pass filter processing. Namely, the reproducing means is allotted with additional performance under the filter mode for digitally processing the waveform by filtering to impart a specific sound effect to the musical tone such as to modify timbre of the reproduced tone.

The pitch mode is selected for reproducing the recorded musical tone with a desired pitch shift. In the other operation modes than the pitch mode, the musical tone is reproduced at an original pitch as it is. When the pitch mode is designated using the mode change-over switch, by simultaneously operating one of the pads, the user specifies desired waveform data to be replayed in the pitch mode. Thereafter, when the specified one of the ten pads is set on, the designated waveform data is replayed with a specified pitch corresponding to that pad. Only two tones can be reproduced concurrently in this mode. Although the pad for designating the waveform to be replayed is used commonly as the pitch specifying means, the pitch specifying means may be provided separately from the pad. The waveform is digitally processed under the pitch mode by changing reading speed of the data such as to shift or modify the original pitch of the corresponding musical tone.

The scratch mode is selected for realizing the scratch operation by the user. When the scratch mode is designated using the mode change-over switch, the user simultaneously designates desired one of the pads. Waveform data corresponding to that pad is subjected to the scratch operation. Thereafter, by touching the ribbon controller 106, the waveform data starts to be replayed. Further, by moving the touch position on the ribbon controller 106, the tone is scratch-replayed. Further, in this mode, apart from the scratch reproduction, only two tones can be reproduced concurrently in the normal mode using the ten pads. The waveform is digitally processed under the scratch mode by irregularly changing reading addresses of the data so as to reproduce a musical tone with the scratch effect.

The EX filter mode is selected for filtering fresh waveform data fed from the external source 111 and for outputting the filtered waveform data to the sound system 114. A cut-off frequency of the filtering can be changed by the user by means of the ribbon controller 106. In the EX filter mode, it is arranged that the replay of the stored waveform is suspended even if the pads are operated by the user.

The EX scratch mode is selected for applying the scratch operation to the fresh waveform fed from the external source 111. In the EX scratch mode, when the ribbon controller 106 is not touched, the waveform from the external source 111 is outputted as it is to the sound system 114. At a moment of touching the ribbon controller 106, the direct sound output to the sound system from the external source is stopped, and the scratch reproduction by the ribbon controller 106 is performed for the external input waveform received at that moment. In the EX scratch mode, it is arranged that the replay of the stored waveform corresponding to each pad is suspended even upon pad-on.

Figure 2:
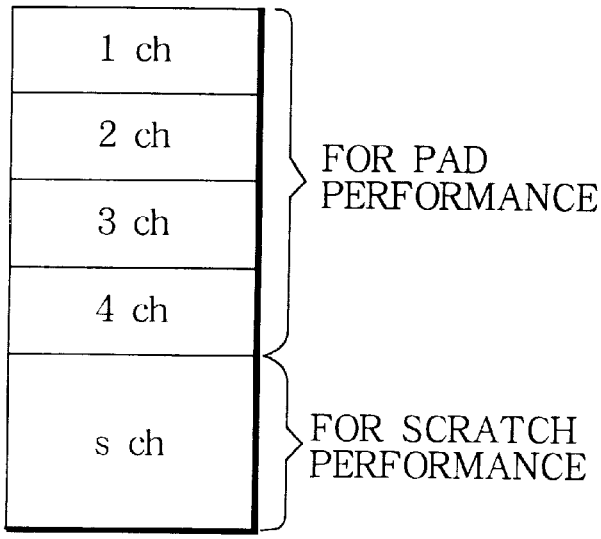
FIGS. 2(*a*)–2(*e*) are diagrams showing various working regions in the sampler of FIG. 1.
Figure 2:
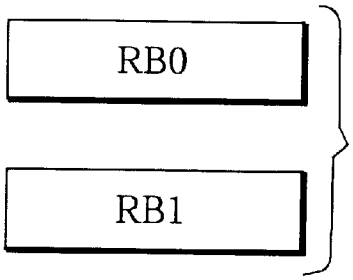
Figure 2:
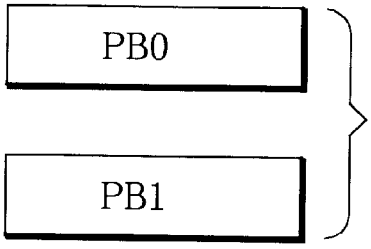
Figure 2:
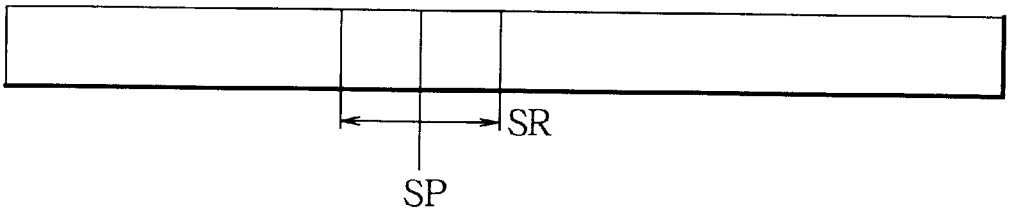
Figure 2:
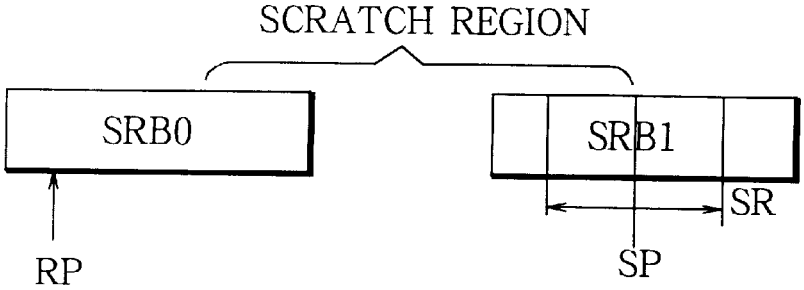

Next, registers, buffers and the like provided in the RAM 104 will be explained. FIG. 2(*a*) shows a sound source register provided in the RAM 104. The sound source register is comprised of 4-channel regions (1*ch*–4*ch*) for the pad performance and a sound source register sch for the scratch reproduction. The register for each channel stores various data such as addresses for reading out waveform data and note-on data.

FIG. 2(*b*) shows a recording buffer provided in the RAM 104. The recording buffer is provided with two buffers, that is, RB0 and RB1, each of which can store waveform data of 128 samples. Upon recording, waveform samples are stored in one of the recording buffers. Namely, the waveform data fed from the external source 111 is transferred to the one recording buffer via the input FIFO of the sound I/O 112 by the DMA controller 113. When the one recording buffer is filled up, the waveform samples of the one recording buffer is written into the flash memory 103 by the CPU 101. Along with this, the storage of waveform samples continues into the other of the recording buffers. In this fashion, the two recording buffers are alternately used for continuously recording the waveform. RBk (k=0 or 1) represents the recording buffer currently performing the recording or storing of waveform data, while RB$\overline{k}$ represents the other recording buffer. $\overline{k}$ represents an inversion of $\overline{k}$ (when k=0, $\overline{k}$=1, when k=1, $\overline{k}$=0).

FIG. 2(*c*) shows a reproducing buffer in the RAM 104. The reproducing buffer is provided with two buffers, that is, PB0 and PB1, each of which can store waveform data of 128 samples. One of the reproducing buffers is used for the tone reproduction. Namely, the waveform data in the one reproducing buffer is transferred to the sound I/O 112 by the DMA controller 113 and is outputted via the output FIFO. The other reproducing buffer is provided to store waveform data to be outputted next by the CPU 101. In this fashion, the two reproducing buffers are alternately used for the tone reproduction. PBr (r=0 or 1) represents the reproducing buffer currently transferring waveform data to the sound I/O 112 for reproduction, while PB$\bar{r}$ represents the other reproducing buffer. $\bar{r}$ represents an inversion of r (when r=0, $\bar{r}$=1, when r=1, $\bar{r}$=0).

FIG. 2(*d*) shows a scratch region SR provided in the RAM 104. The scratch region SR is prepared when the scratch mode is designated. When the scratch mode is set, the waveform data corresponding to the designated pad is ADPCM expanded with linear 16 bits, and is developed in an area of the RAM 104. It is determined in advance as to which part of the waveform data is set to the scratch region SR. A certain address on the scratch region SR is set in a scratch pointer SP as a scratch start address. A value of the scratch pointer SP can be changed by the user. When the user operates the ribbon controller 106 in the scratch mode, the scratch reproduction is performed. In this case, when an initial touch is given to the ribbon controller 106 at any position, the scratch reproduction is started from the start address designated by the scratch pointer SP.

FIG. 2(*e*) shows a scratch region prepared in the EX scratch mode. In the EX scratch mode, the waveform data from the external source 111 is stored in recording buffers SRB0 and SRB1. The recording buffers SRB0 and SRB1 are corresponding to the recording buffers RB0 and RB1 explained with reference to FIG. 2(*b*), and are alternately used likewise RB0 and RB1. Each of SRB0 and SRB1 has a sufficient memory capacity for performing the scratch. For example, when the sampling clock is 40 kHz, the memory capacity is capable of storing no less than about 40 k samples. One of SRB0 and SRB1 which is not used at a moment when the operation of the ribbon controller 106 is started, is set as the scratch region. Since there is a recording pointer RP which indicates a writing address in the recording buffer SRB0, the data writing is currently performed into SRB0. Accordingly, a part of the other recording buffer SRB1 into which the data writing is not performed is set as the scratch region SR. Further, a certain address in the scratch region SR is set in the scratch pointer SP as a scratch start reading address.

Next, registers other than those shown in FIGS. 2(*a*)–2(*e*) will be listed below:

(1) m: an operation mode register. 0 represents the normal mode, 1 the sampling mode, 2 the filter mode, 3 the pitch mode, 4 the scratch mode, 5 the EX filter mode, and 6 the EX scratch mode.

(2) PN: a register for storing pad numbers for identifying the pads.

(3) i: a register for storing channel numbers of the channels for assigning or allocating thereto tone generation.

(4) FNi: a register for storing an F number of the i-th channel where tone generation is allocated.

(5) TMP: a register for storing a detection value of the ribbon controller 106.

(6) RD: a register used when a detection value from the ribbon controller 106 is changed for setting that detection value.

(7) RS: a flag for indicating a state of the ribbon controller 106. When the ribbon controller 106 is operated in manner such as a finger or the like is in touch with the ribbon controller 106, the flag is set to 1. When a finger or the like is not in touch with the ribbon controller 106, the flag is set to 0.

(8) VEL: a register for setting the speed of touch action along the ribbon controller 106, specifically, the speed of movement of the finger or the like which is in touch with the ribbon controller 106.

(9) OLD: a register for holding a last detection value of the ribbon controller 106.

(10) SAD: a register for storing a scratch reading address.

(11) ADi: a register for storing a reading address in the i-th channel (i=1–4).

(12) SFN: a register for storing an F number used when reading out waveform data from the scratch channel sch.

(13) RP: a recording pointer for indicating a writing address of waveform data into the recording buffer.

(14) PP: a reproducing pointer for indicating a reading address of waveform data from the reproducing buffer.

The foregoing symbols showing the registers and the like also represent storage regions of the registers and the like, and further represent data stored in those storage regions. For example, m represents not only the operation mode register but also the data indicative of an operation mode stored in that register.

FIGS. 3 to 16 are flowcharts for explaining operations of the CPU 101 and the DMA controller 113 in the sampler of FIG. 1. Hereinbelow, a hierarchical structure of the software will be first explained, and then a processing procedure of each of the software modules will be explained according to the flowcharts of FIGS. 3 to 16. Thereafter, the description is given on what timings the software modules are executed so as to achieve the function of each mode.

Figure 3:
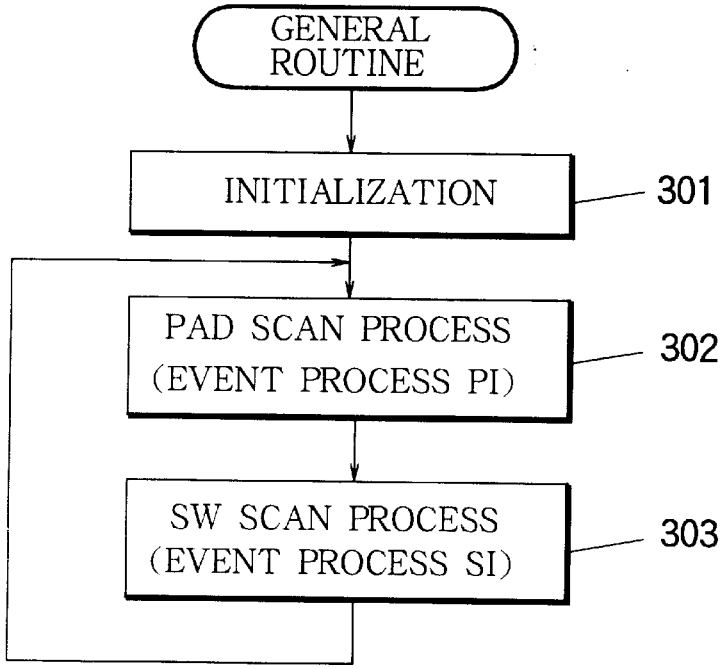
FIG. 3 is a flowchart of a general routine.
Figure 9:
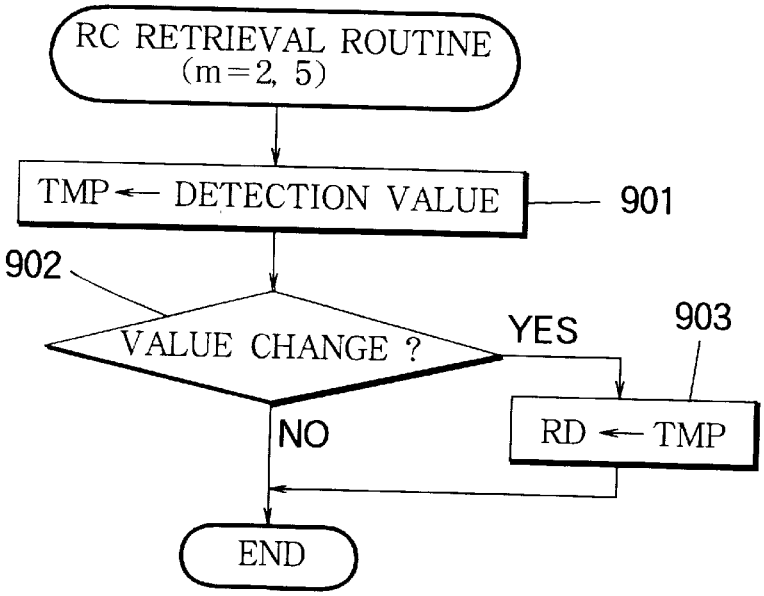
FIG. 9 is a flowchart of a ribbon controller detection value retrieving routine RC(m)(m=2, 5).
Figure 10:
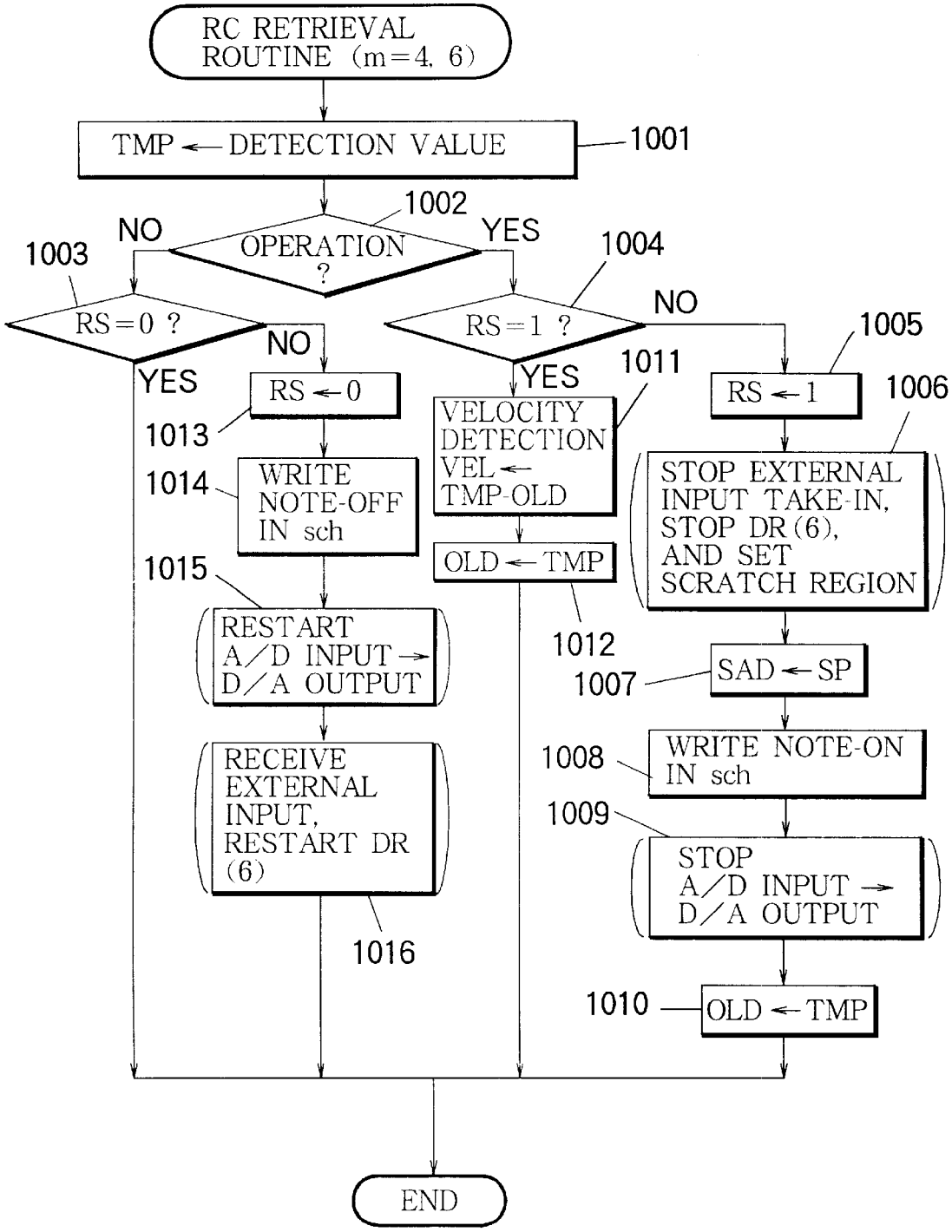
FIG. 10 is a flowchart of another ribbon controller detection value retrieving routine RC(m) (m=4, 6).
Figure 11A:
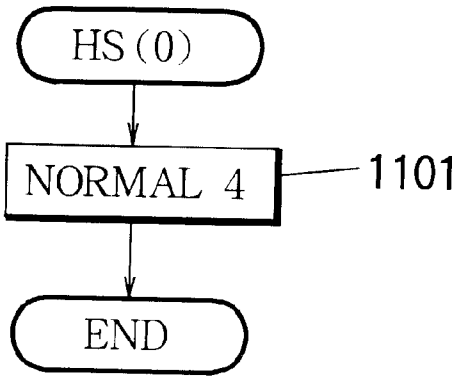
FIGS. 11(*a*)–11(*c*) are flowcharts of waveform processing routines HS(m)(mode m=0, 2, 3).
Figure 11B:
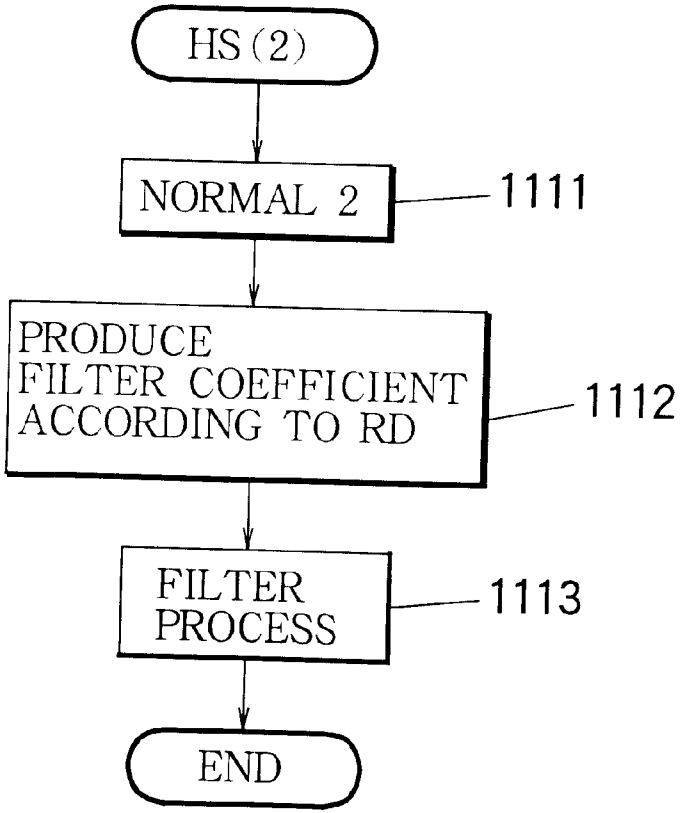
Figure 11C:
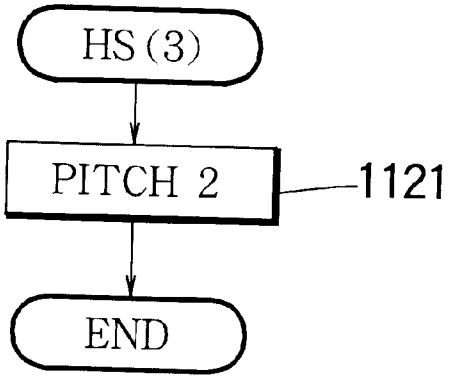
Figure 16:
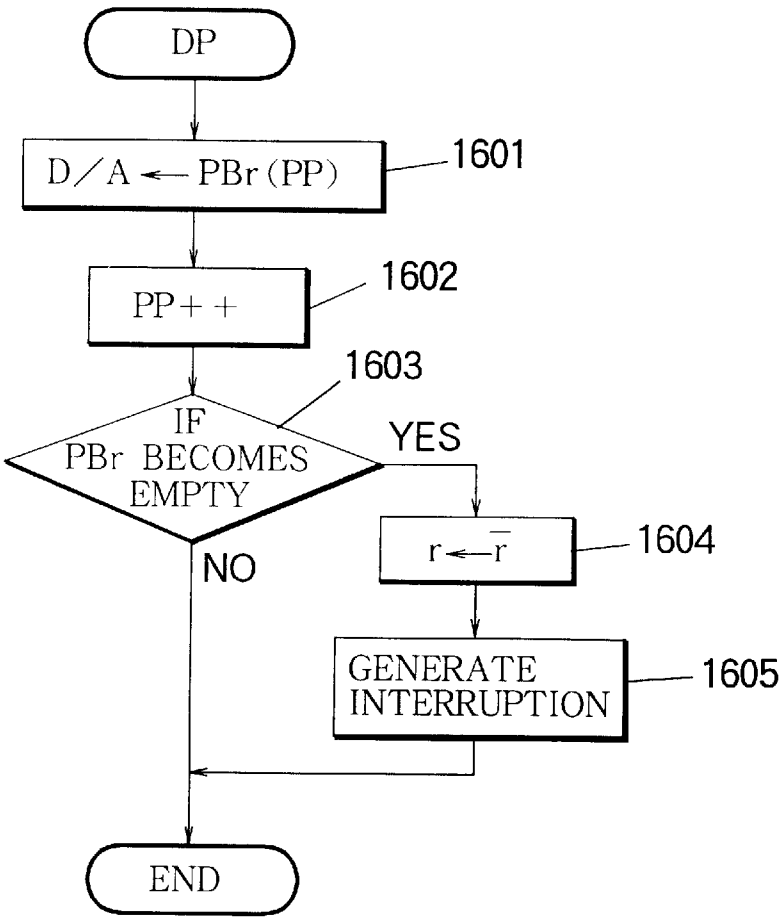
FIG. 16 is a flowchart of a DP routine.
Figure 15:
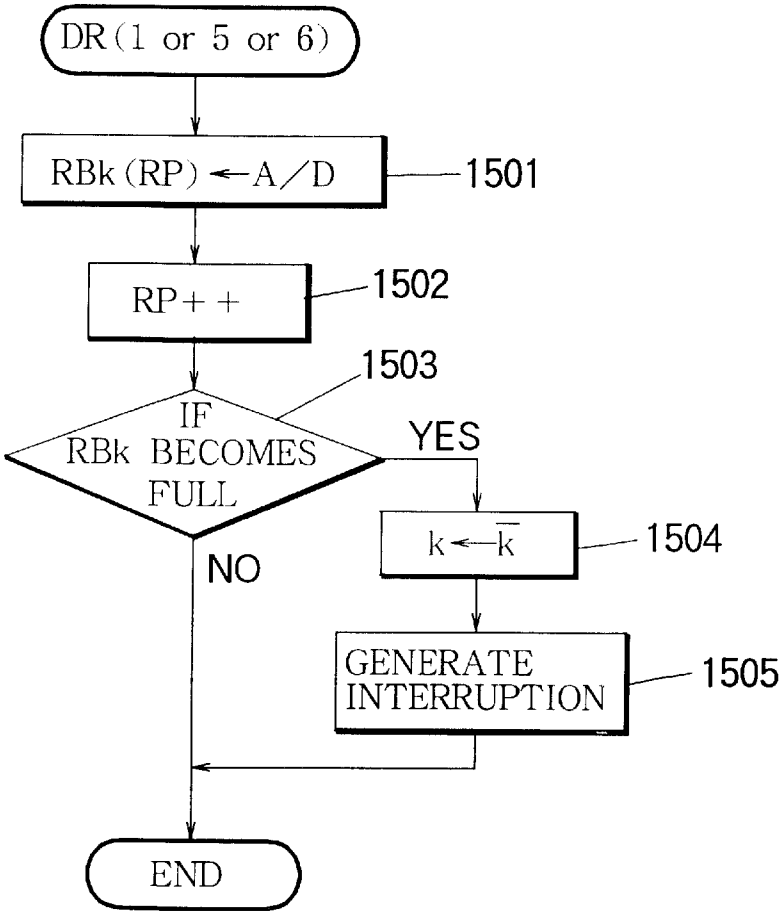
FIG. 15 is a flowchart of a DR(m) routine (mode m=1, 5, 6).

First, the hierarchical structure of the software is explained. The programs shown in FIGS. 3 to 16 are classified as follows:

level 1: a DR(m) routine of FIG. 15 operating the DMA controller 113 in the waveform recording, and a DP routine of FIG. 16 operating the DMA controller 113 in the waveform reproduction.

level 2: waveform generation routines HS(m) of FIGS. 11(*a*) to 12(*c*) performing waveform preparation by the CPU 101, and ribbon value retrieval routines RC(m) of FIGS. 9 and 10 retrieving the detection value of the ribbon controller 106 by the CPU 101. Process routines of FIGS. 13(*a*), 13(*b*) and 14 are included here as subroutines of the waveform generation routines HS(m).

level 3: a general routine of FIG. 3 executed by the CPU 101. A pad scan routine, a SW scan routine and various event routines of FIGS. 4 to 8 are included here as subroutines of the general routine.

The process routines of level 1 have the highest priority. Specifically, when an interruption for executing the process routine of level 1 takes place while the process of level 2 or 3 is executed, the process routine of level 1 is executed with the highest priority. The processes DR(m) and DP of level 1 are not executed by the CPU 101 but executed by the DMA controller 113. Thus, when the interruption for the process of level 1 takes place, the operation of the CPU 101 is stopped while the DMA controller 113 holds the bus line 115 so as to execute the process of level 1 with the highest priority. The interruption for the process of level 1 is timed by the sampling clock Fs. Specifically, the interruption takes place every sampling clock Fs so that the DMA controller 113 executes DP in the waveform reproduction, and DR(m) in the waveform recording. Whether DP or DR(m) is executed or not upon the interruption at each sampling clock Fs is designated to the DMA controller 113 from the CPU 101 in advance.

The process of level 2 has the priority which is lower than that of the process of level 1 but higher than that of the process of level 3. Specifically, when an interruption for executing the process of level 2 takes place while the general routine of level 3 is executed, the process routine of level 2 is executed with priority. The DP routine of the DMA controller 113 reproduces or reads out the waveform data from the reproducing buffer and interrupts the CPU 101 when the reproducing buffer becomes vacant. In response to this interruption, the CPU 101 executes the waveform generation routine HS(m) and provides next sample values of the waveform to the reproducing buffer. The ribbon value retrieval routine RC(m) is started by a timer interruption. Specifically, the timer interruption takes place every clock outputted from the timer 105 at a given interval so that the CPU 101 executes the ribbon value retrieval routine RC(m) to take in the detection value of the ribbon controller 106.

The level 3 represents the process routine having the lowest priority. The CPU 101 repeatedly executes the general routine of FIG. 3 and further executes the given subroutines upon occurrence of an on-event of the pad 107 or an operation event of the panel SW 109.

Next, the operating procedure of the respective software modules will be explained according to the flowcharts of FIGS. 3 to 16. FIG. 3 shows the general routine of level 3. When the sampler is powered on, the CPU 101 executes this general routine. First at step 301, various initial settings are executed. In particular, the operation mode m is set to the normal mode as indicated by m=0, a note-off command is set to all the channels of the sound source register of FIG. 2(*a*), and all the sample regions of the reproducing buffers PB0 and PB1 are cleared to zero. During the initialization, the CPU 101 instructs the reproducing process to the DMA controller 113. In response to this, the DMA controller 113 interrupts the CPU 101 every sampling clock Fs from the Fs clock generator 110 and executes the DP routine of FIG. 16 upon every interruption so as to start the operation of reproducing the waveform data held in the reproducing buffer. Further, the timer 105 is started during the initialization. By this, the CPU 101 executes the RC retrieval routine RC(m) upon every timer interruption based on the clock from the timer 105 so as to start the process of retrieving the detection value from the ribbon controller 106.

Next, a pad scan process is executed at step 302, then an SW scan process is executed at step 303, and thereafter the routine returns to step 302 to repeat the same processes. The pad scan process of step 302 is carried out to detect whether there is any on-event of the ten pads 107, and executes the on-event routines shown in FIGS. 7 and 8 when there is the on-event. The SW scan process of step 303 is carried out to detect whether operation of the panel SW 109 is performed or not, and executes the process routine corresponding to that operation when the operation is performed.

Figure 4:
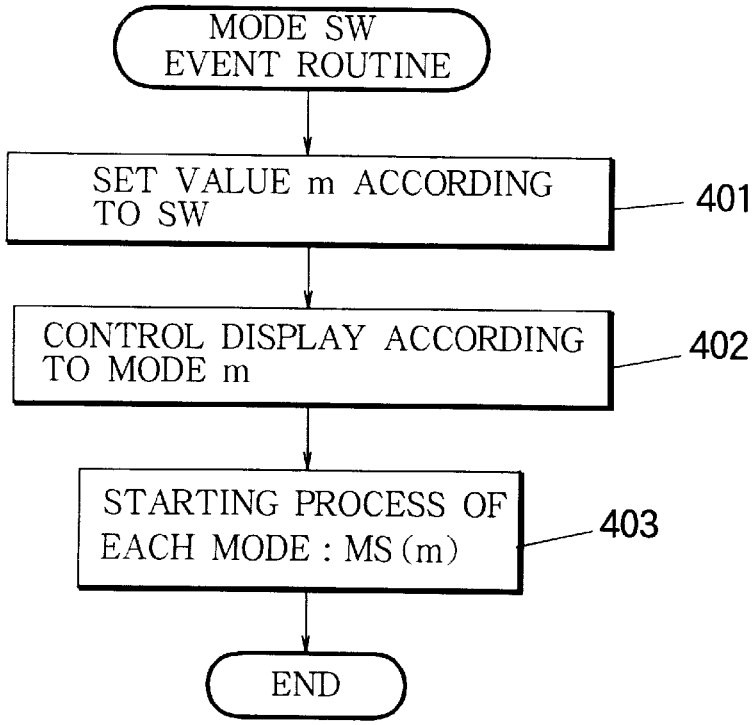
FIG. 4 is a flowchart of a mode SW event routine.

FIG. 4 shows a mode SW event routine which is called upon detection of the actuation of the mode change-over switch in the SW scan process of step 303 in FIG. 3. In the mode SW event routine, a value indicative of the operation mode designated depending on the operation of the mode change-over switch is set in the register m at step 401, and the display 108 is controlled according to the designated mode m at step 402. Then, a starting process MS(m) corresponding to the designated mode m is executed at step 403, and thereafter the process is terminated.

Figure 5:
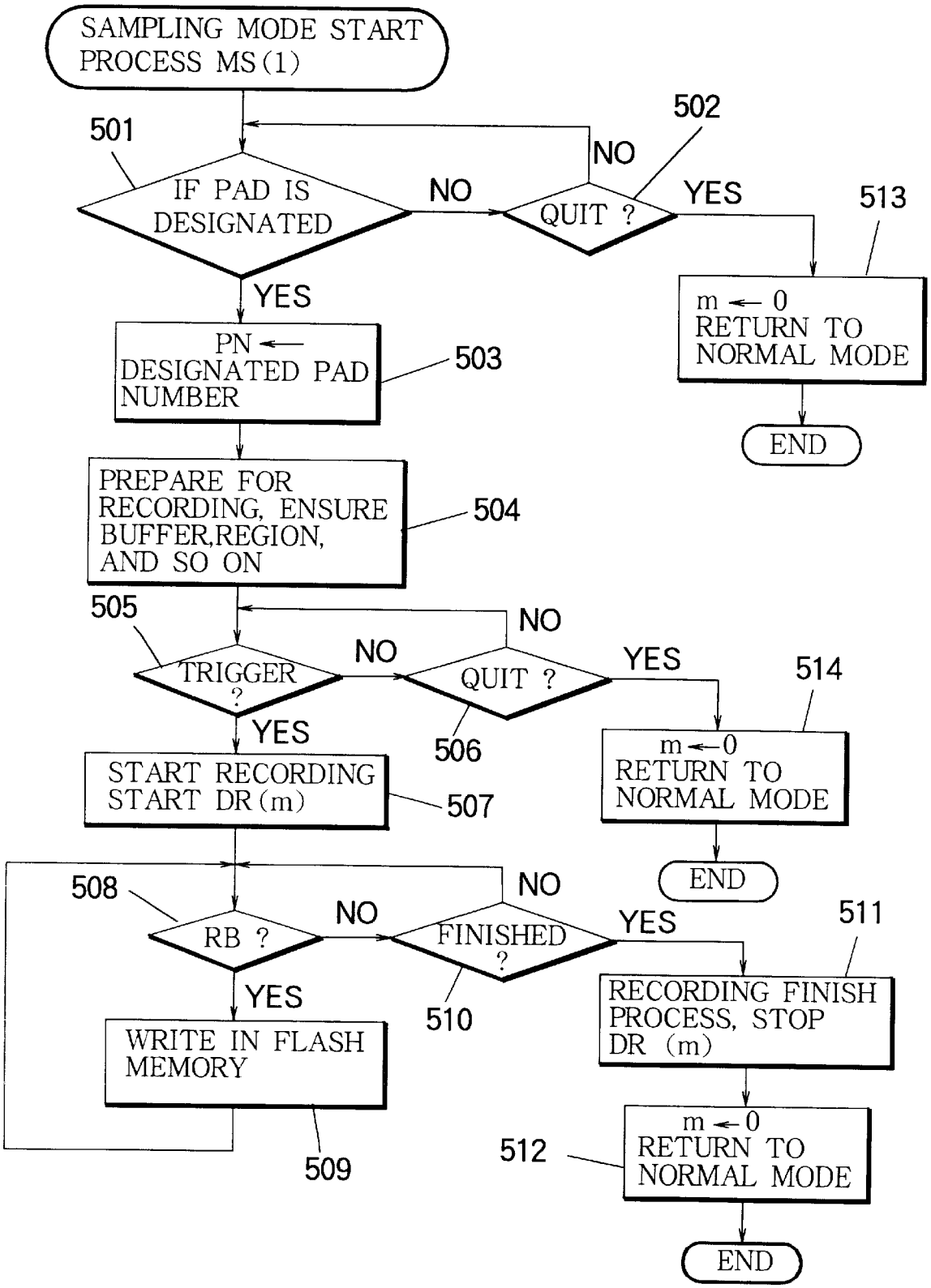
FIG. 5 is a flowchart of a sampling mode start process MS(1).

FIG. 5 is a flowchart of a sampling mode start process MS(1) which is called at step 403 in FIG. 4 when the user designates the sampling mode (m=1) using the mode change-over switch. In the MS(1) process, first at step 501, it is determined whether the designation of a pad is performed. If the designation of any pad is not performed, step 502 determines whether the designation of the sampling mode is quit or not. If the designation of the sampling mode continues, the routine returns to step 501 so as to urge the designation of the pad.

If the designation of any pad is effected at step 501, a number of the designated pad is stored or reserved in the register PN at step 503, and recording preparation is performed at step 504. The recording preparation is performed for ensuring the recording buffers RB0 and RB1, the recording region on the flash memory 103 and other regions. Further, the DMA controller 113 is instructed to stop the execution of the DP routine which is executed by interrupting the CPU 101 each sampling clock Fs. Next, at step 505, it is determined whether a condition (trigger) for starting the recording is satisfied or not. The condition for the start of recording, for example, is such that the recording is started when the input level becomes no less than a given value. If the condition for the start of recording is not satisfied, step 506 determines whether to stop the recording. If the recording continues, the routine returns to step 505.

If the condition for the start of recording is satisfied at step 505, the recording is actually started at step 507. The start of recording is, specifically, effected by instructing the start of recording to the DMA controller 113 from the CPU 101. By this, the DMA controller 113 interrupts the CPU 101 each sampling clock Fs from the Fs clock generator 110, and executes the DR(1) routine of FIG. 15 upon every interruption so as to start a process of setting the waveform data inputted from the external source 111 into the recording buffer RBk via the input FIFO in the sound I/O 112.

Next, at step 508, it is determined whether the recording buffer is filled up. As will be explained in detail with reference to FIG. 15, in the DR(1) routine, the waveform samples of the external source are transferred to the recording buffer RBk. When RBk is filled up, k is inverted to cause the interruption. Step 508 awaits this interruption and determines whether the recording buffer is filled up. If the interruption takes place, this means that the recording buffer RB$\bar{k}$ is filled with the waveform samples. Thus, the waveform samples of the recording buffer RB$\bar{k}$ are written into a predetermined region of the flash memory 103 at step 509, and thereafter the routine returns to step 508.

If the recording buffer is not filled up (no interruption from the DR(1) routine) at step 508, step 510 determines whether to finish the recording process. The recording process is finished upon an on-event of a recording stop switch of the panel SW 109 or when the recording region ensured in the flash memory 103 is filled up. If it is judged that the recording process should not finish at step 510, the routine returns to step 508 to continue the recording. If it is judged that the recording process should finish at step 510, the recording finish process is executed at step 511 by instructing the DMA controller 113 to stop the execution of the DR(1) routine. Then, at step 512, the register m is set to 0 to return to the normal mode, and the process is finished. In return to the normal mode, the DMA controller 113 is instructed to start the execution of the DP routine by interrupting the CPU 101 per sampling clock Fs. In similar manner, if the sampling mode start process is quit at step 502, the register m is set to 0 to thereby return to the normal mode at step 513, and then the process is finished. Further, if the recording process is quit at step 506, the register m is set to 0 to thereby return to the normal mode at step 514, and then the process is finished. Process at steps 513, 514 is the same as that of step 512.

Figure 6:
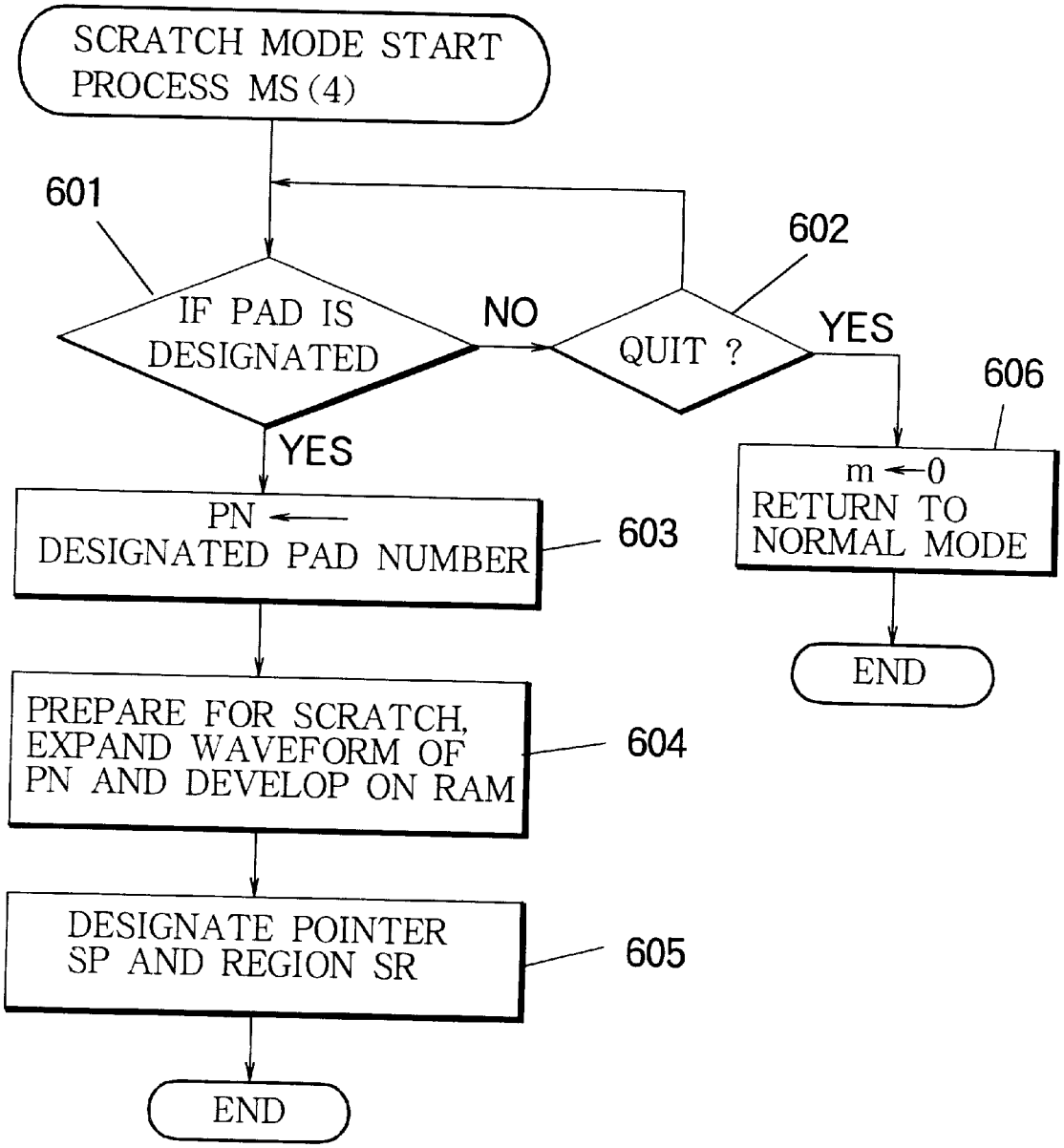
FIG. 6 is a flowchart of a scratch mode start process MS(4).

FIG. 6 is a flowchart of the scratch mode start process MS(4) which is called at step 403 in FIG. 4 when the user designates the scratch mode (m=4) using the mode change-over switch. In the MS(4) process, first at step 601, it is determined whether the designation of a pad is performed or not. If the designation of any pad is not performed, step 602 determines whether to quit the designation of the scratch mode. If the designation process of the scratch mode should be continued, the routine returns to step 601 so as to urge the designation of the pad.

If the designation of any pad is performed at step 601, a number or code of the designated pad is reserved in the register PN at step 603. Then, preparation for performing the scratch is made at step 604. This is a process of reading out the waveform data recorded corresponding to the pad number PN from the flash memory 103, ADPCM-expanding the read waveform data and developing the expanded waveform data in a given region of the RAM 104. Then at step 605, a desired part of the waveform data developed in the given region of the RAM 104 is set to be the scratch region SR (FIG. 2(*d*)), and the scratch pointer SP representing an address of starting the scratch is set to a predetermined value. If the scratch mode designating process is quit at step 602, the register m is set to 0 to thereby return to the normal mode at step 606, and the process is finished.

Figure 7:
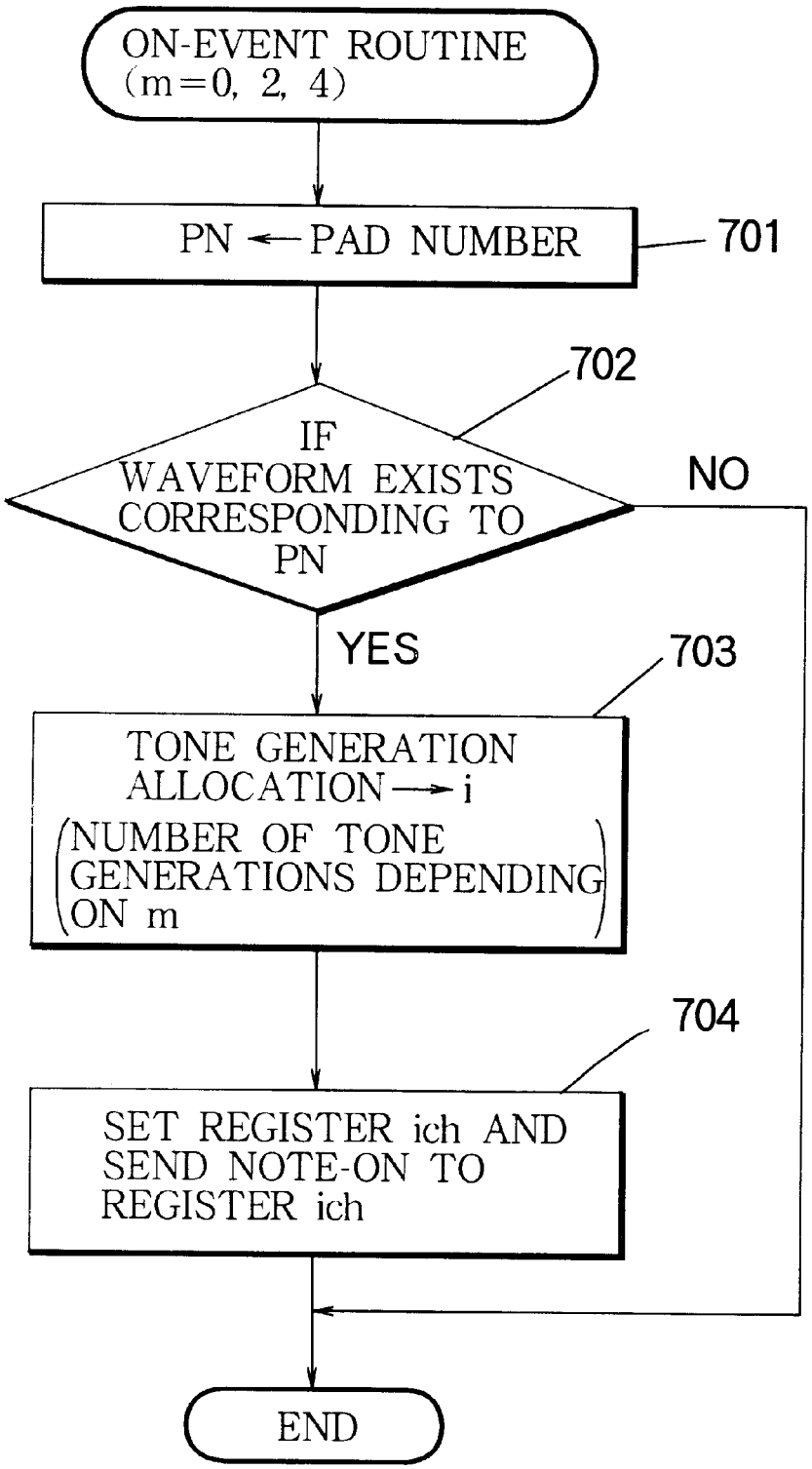
FIG. 7 is a flowchart of an on-event routine (mode m=0, 2, 4).

FIG. 7 shows a flowchart of the pad on-event routine which is called upon detection of the on-event of the pads 107 at step 302 in FIG. 3 when the mode m is set to the normal mode, the filter mode or the scratch mode (m=0, 2, 4). In this on-event routine, first at step 701, a pad number of the pad 107 where the on-event occurs is set in the register PN. Then, step 702 determines whether the waveform data corresponding to the pad number PN is reserved on the flash memory 103. If there is no waveform data corresponding to the pad number PN, the process is finished. If the waveform data corresponding to the pad number PN is found at step 702, allocation or assignment of the tone generation channel is performed at step 703. This channel allocation is performed within the maximum number of tone generations depending on the mode m. Specifically, in the normal mode, since four tones can be concurrently generated at most, if there is a vacant channel in the first to fourth channels, each tone generation is allocated to that vacant channel. On the other hand, if all the four channels are used for tone generation, the tone generation is ceased in the oldest channel where the tone generation is started from the oldest time point, and another tone generation is newly allocated to that channel. In the filter mode or the scratch mode, since two tones can be concurrently generated at most, each tone generation is allocated to the first or second channel in a similar fashion. A number of the allocated channel is set in the register i. Subsequently, at step 704, various data for performing the tone generation including a head address ADi of waveform data to be reproduced are set in the sound source register ich of the i-th channel. The note-on command is further set and the process is finished.

Figure 8:
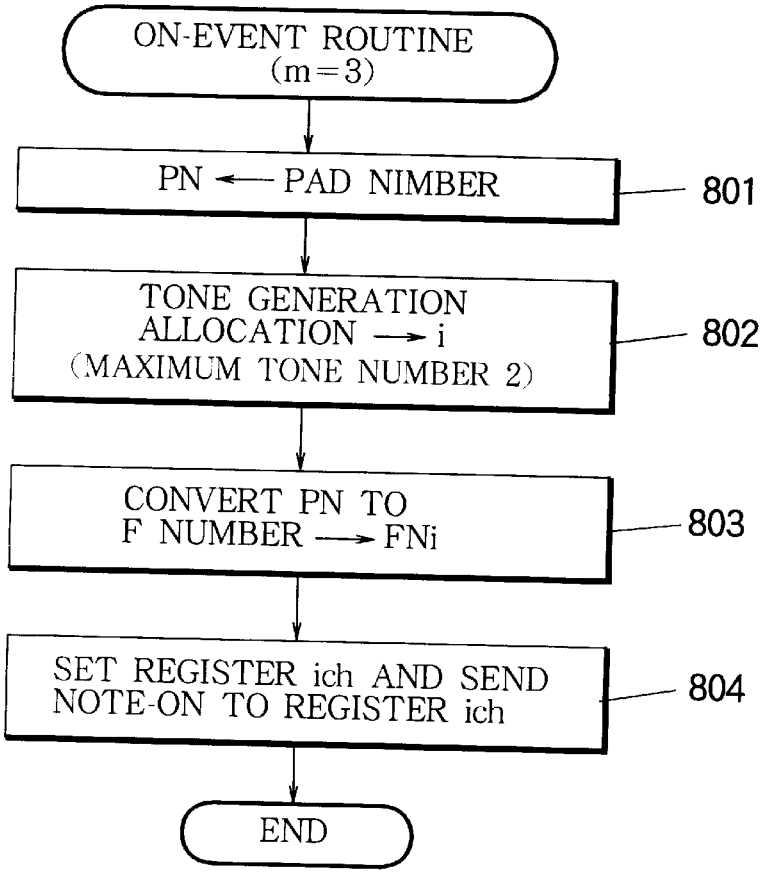
FIG. 8 is a flowchart of another on-event routine (mode m=3).

FIG. 8 shows a flowchart of the pad on-event routine which is called upon detection of the on-event of the pads 107 at step 302 in FIG. 3 when the mode m is set in the pitch mode (m=3). In the pad on-event routine, first at step 801, a pad number of the pad 107 where the on-event occurs is set in the register PN. Then, the tone generation channel allocation is performed at step 802. In the pitch mode, since two tones can be concurrently generated at most, the channel allocation is performed within the maximum tone generation number 2. Then, at step 803, the pad number PN is converted into a corresponding F number which is set in the register FNi. Subsequently, at step 804, various data including a start address of reading waveform data to be reproduced and F number FNi are set for achieving the reproduction of the musical tone with a pitch shift in the sound source register ich of the i-th channel. The note-on command is further set, and thereafter the process is finished. In this process, one pad 107 is depressed to designate a desired waveform, and to concurrently specify a corresponding F number, which is set to the sound source register ch to determine a pitch applied to the reproduced tone.

FIG. 9 is a flowchart of the RC retrieval routine RC(m) for taking in the detection value of the ribbon controller 106 when the mode m is set in the filter mode or the EX filter mode (m=2 or 5). This is a process of taking in the detection value for performing the filter control by the ribbon controller 106. FIG. 10 is a flowchart of the RC retrieval routine RC(m) for taking in the detection value of the ribbon controller 106 when the mode m is set in the scratch mode or the EX scratch mode (m=4 or 6). This is a process of taking in the detection value for performing the scratch control by the ribbon controller 106. The timer 105 is started during the initialization at step 301 in FIG. 3. The CPU 101 executes the timer interruption at a given time interval. The RC retrieval routine RC(m) of FIG. 9 is executed when the mode m is set to 2 or 5 by the timer interruption. On the other hand, the other RC retrieval routine RC(m) of FIG. 10 is executed when the mode m is set to 4 or 6 by the timer interruption.

The RC retrieval routine RC(m) (m=2, 5) of FIG. 9 is first explained. First at step 901, the detection value of the ribbon controller 106 is set in the register TMP. Subsequently, at step 902, it is determined whether a succeeding detection value changes as compared to a preceding detection value retrieved at the last timer interruption. If there is no change, the process is finished. If there is a change, the detection value TMP is set in the register RD at step 903 and the process is finished. As a result, the detection value of the ribbon controller 106 is set in the register RD. If a finger or the like is removed from the ribbon controller 106, the detection value TMP and RD may be returned to a default value, or the value immediately before the removal of the finger or the like may be held.

The RC retrieval routine RC(m) (m=4, 6) of FIG. 10 will be explained. FIG. 10 is a flowchart for explaining both of the RC retrieval routine RC(4) which is called when the operation mode is set to the scratch mode (m=4), and the RC retrieval routine RC(6) which is called when the operation mode is set to the EX scratch mode (m=6). Since steps 1006, 1009, 1015 and 1016 represent processes only for the RC(6), the operation procedure of the RC(4) will be first explained and then the operation procedure of the RC(6) will be explained hereinbelow.

In the ribbon controller detection value retrieval routine RC(4), first at step 1001, the detection value of the ribbon controller 106 is set in the register TMP. Then at step 1002, it is determined whether the ribbon controller 106 is operated. The ribbon controller 106 outputs a coordinate detection value indicative of a coordinate position where a finger, a rod or the like is touched, while the ribbon controller 106 outputs a default value when the finger, the rod or the like is not in touch so that the non-touch (the non-operation) can be recognized. When the ribbon controller 106 is not operated, the routine proceeds to step 1003. When the ribbon controller 106 is operated, the routine proceeds to step 1004.

At step 1003, it is determined whether the status register RS of touch action is 0 or not. If the register RS is 0, this means that the ribbon controller 106 is not operated both in the last interruption and in the current interruption. Thus, the process is finished. If RS is not 0 at step 1003, this means that the ribbon controller 106 has been operated in the last interruption while the ribbon controller 106 is not operated (the finger, the rod or the like is removed) in the current interruption. Thus, the register RS is cleared to 0 at step 1013, the note-off command is written in the sound source register sch of the scratch channel at step 1014, and the process is finished.

At step 1004, it is determined whether the register RS is 1 or not. If the register RS is not 1, this means that the ribbon controller 106 has not been operated in the last interruption while the ribbon controller 106 is operated in the current interruption. Thus, the register RS is set to 1 at step 1005 and the velocity VEL is set to 0. Then at step 1007, a reading address SAD is set to a predetermined value of the scratch pointer SP. Next, at step 1008, various data for the scratch reproduction including a reading address of waveform data to be scratch-reproduced and a velocity value VEL are set, and the note-on command is written in the sound source register sch of the scratch channel. Subsequently, at step 1010, the current detection value TMP of the ribbon controller 106 is set in the register OLD, and the process is finished.

If the check result is YES at step 1004, this means that RS=1 in the last interruption and also RS=1 in the current interruption (the operation of the ribbon controller 106 is continued). Thus, the velocity of the touch action on the ribbon controller 106 is detected and set in the register VEL at step 1011. The velocity VEL is derived through differential computation by subtracting the detection value OLD in the last interruption from the current detection value TMP. Thus, it is possible that the velocity VEL takes a negative value. Further, the velocity VEL is set in the sound source register sch of the scratch channel. Then, at step 1012, the current detection value TMP is set in the register OLD, and the process is finished.

Explanation has been made to the RC retrieval or take-in routine RC(4) when the mode is set to the scratch mode (m=4). In the RC take-in routine RC(6) when the mode is set to the EX scratch mode (m=6), step 1006 is added after step 1005, step 1009 is added after step 1008, and steps 1015 and 1016 are added after step 1014. Further, processes at steps 1008 and 1014 are somewhat different. Hereinbelow, explanation will be made therefor. At the time of starting the operation of the ribbon controller 106, the routine proceeds from step 1004 to step 1006 via step 1005. At step 1006, the CPU 101 instructs the DMA controller 113 to stop the execution of the RD(6) routine by interrupting the CPU 101 per sampling clock Fs, and the scratch region SR is set in the recording buffer SRB$\bar{k}$ which is one of the two recording buffers SRB0 and SRB1 currently not used, as explained with reference to FIG. 2(*e*). Then, the routine proceeds to step 1008 via step 1007. At step 1008, various data for the scratch reproduction including a reading address SAD of waveform data to be scratch-reproduced and velocity value VEL are set and the note-on command is written in the sound source register sch of the scratch channel. Further, at step 1008, the following process is also performed before the foregoing process. Specifically, first, 128 samples of one waveform are provided in the reproducing buffer PBr. In this process, after clearing the reproducing buffer PBr to 0, the later-described EX scratch process of FIG. 14 may be performed relative to the reproducing buffer PBr (PB$\bar{r}$ is used instead of PBr in FIG. 14). Further, the CPU 101 instructs the DMA controller 113 to restart the execution of the DP routine by interrupting the CPU 101 per sampling clock Fs. Further, an interruption of the same significance as a later-described interruption caused at step 1605 of the DP routine in FIG. 16 is generated. Through this interruption, the HS(6) is executed so that next 128 samples to be scratch-reproduced are provided in the PB$\bar{r}$. Thereafter, at step 1009, under the command from the CPU 101, the direct connection from the A/D input to the D/A output of the sound I/O 112 is disabled so as to stop the sound emission of feeding the musical tone signal from the external source 111 directly to the sound system 114.

At the time of stopping the operation of the ribbon controller 106, the routine proceeds from step 1002 to step 1014 via steps 1003 and 1013. At step 1014, the note-off event is written in the sound source register sch of the scratch channel, and then the following process is also performed. Specifically, the CPU 101 instructs the DMA controller 113 to stop the execution of the DP routine of interrupting the CPU 101 per sampling clock Fs. On the other hand, at step 1015, under the command of the CPU 101, the direct connection from the A/D input to the D/A output of the sound I/O 112 is restored so as to achieve the sound emission by feeding the musical tone signal from the external source 111 directly to the sound system 114. At step 1016, the CPU 101 instructs the DMA controller 113 to restart the execution of the DP(6) routine by interrupting the CPU 101 per sampling clock Fs.

Figure 12A:
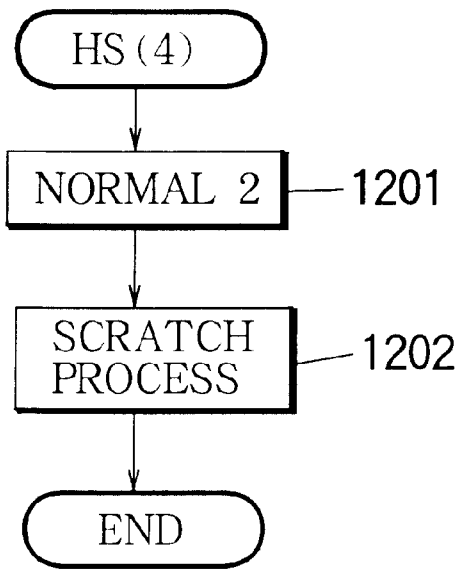
FIGS. 12(*a*)–12(*c*) are flowcharts of waveform processing routines HS(m)(mode m=4, 5, 6).
Figure 12B:
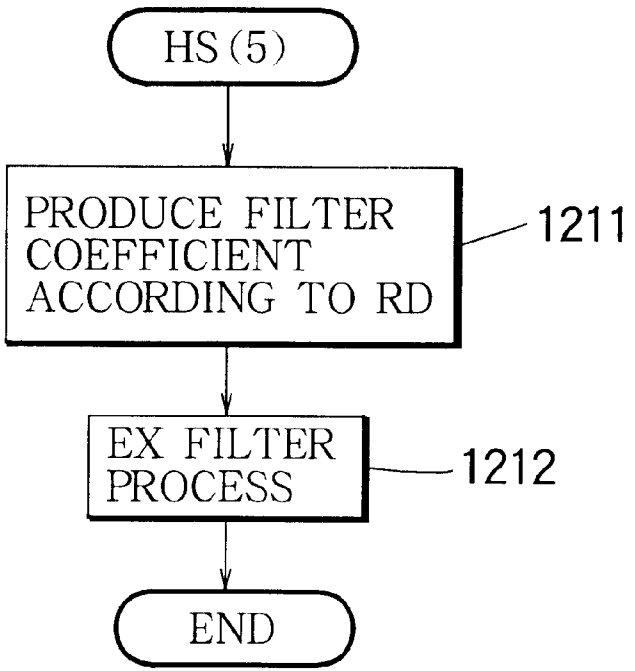
Figure 12C:
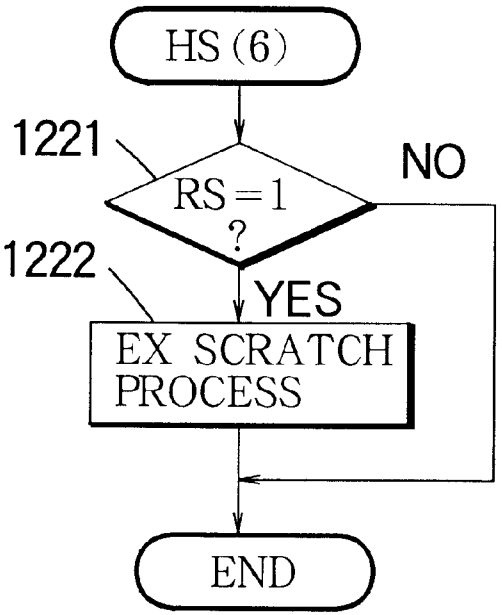

FIGS. 11(*a*) to 11(*c*) and FIGS. 12(*a*) to 12(*c*) are flowcharts of the waveform generation routine HS(m) executed by the CPU 101 for providing sequential sample values of the waveform to the reproducing buffer under the respective modes m. The waveform generation routine HS(m) is executed by the CPU 101 in response to a later-described interruption demand at step 1605 of the DP routine in FIG. 16. Specifically, in the DP routine, one sample value of the waveform held in the reproducing buffer PBr is transferred to the sound I/O 112 each sampling clock Fs so as to perform the reproduction of the musical tone. When the set of 128 sample values in the reproducing buffer PBr are all reproduced, the DP routine inverts k so as to cause an interruption. Upon this interruption as a trigger, the CPU 101 executes the waveform generation routine HS(m) depending on the mode m, and newly produces another set of 128 sample values corresponding to one frame of the reproducing buffer PB$\bar{r}$ which has just finished the reproduction and rendered vacant.

FIG. 11(*a*) is a flowchart of the waveform generation routine HS(0) for generating the waveform sample values on the reproducing buffer under the normal mode. In HS(0), a subroutine denoted "normal 4" is called at step 1101, and the process is finished. This subroutine will be described later with reference to FIG. 13(*a*).

FIG. 11(*b*) is a flowchart of the waveform generation routine HS(2) for generating the waveform sample values on the reproducing buffer under the filter mode. In HS(2), a subroutine "normal 2" is called at step 1111, and a filter coefficient (cut-off frequency) is produced according to the detection value RD of the ribbon controller 106 at step 1112. Then at step 1113, the filter process (low-pass filter process) is performed, and the process is finished. The "normal 2" at step 1111 will be described later with reference to FIG. 13(*a*).

FIG. 11(*c*) is a flowchart of the waveform generation routine HS(3) for generating the waveform sample values on the reproducing buffer under the pitch mode. In HS(3), a subroutine "pitch 2" is called at step 1121, and the process is finished. The "pitch 2" will be described later with reference to FIG. 13(*b*).

FIG. 12(*a*) is a flowchart of the waveform generation routine HS(4) for generating the waveform sample values on the reproducing buffer under the scratch mode. In HS(4), the subroutine of the "normal 2" is called at step 1201, then a scratch process subroutine is called at step 1202, and the process is finished. The "normal 2" will be described later with reference to FIG. 13(*a*). The scratch process subroutine will be described later with reference to FIG. 14.

FIG. 12(*b*) is a flowchart of the waveform generation routine HS(5) for generating the waveform sample values on the reproducing buffer under the EX filter mode. When HS(5) is called, the set of 128 samples (linear samples) of the waveform data fed from the external input 111 are written in the recording buffer RB$\bar{k}$, while the reproducing buffer PB$\bar{r}$ is vacant. Accordingly, in HS(5), first at step 1211, a filter coefficient is produced according to the detection value RD of the ribbon controller 106, and an EX filter process is performed at step 1212. This EX filter process is called for applying the filtering process using the filter coefficient derived at step 1211 to the set of 128 waveform samples held in the recording buffer RB$\bar{k}$, and for setting the resultant 128 waveform samples in the reproducing buffer PB$\bar{r}$. After step 1212, the process is finished.

FIG. 12(*c*) is a flowchart of the waveform generation routine HS(6) for generating the waveform samples in the reproducing buffer under the EX scratch mode. In HS(6), step 1221 determines whether the register RS is 1 or not. If the register RS is not 1, this means that the ribbon controller 106 is not operated. Thus, the process is finished. If the register RS is 1 at step 1221, this means that the ribbon controller 106 is operated. Thus, an EX scratch process is performed at step 1222, and the process is finished. The EX scratch process will be described later with reference to FIG. 14.

Figure 13:
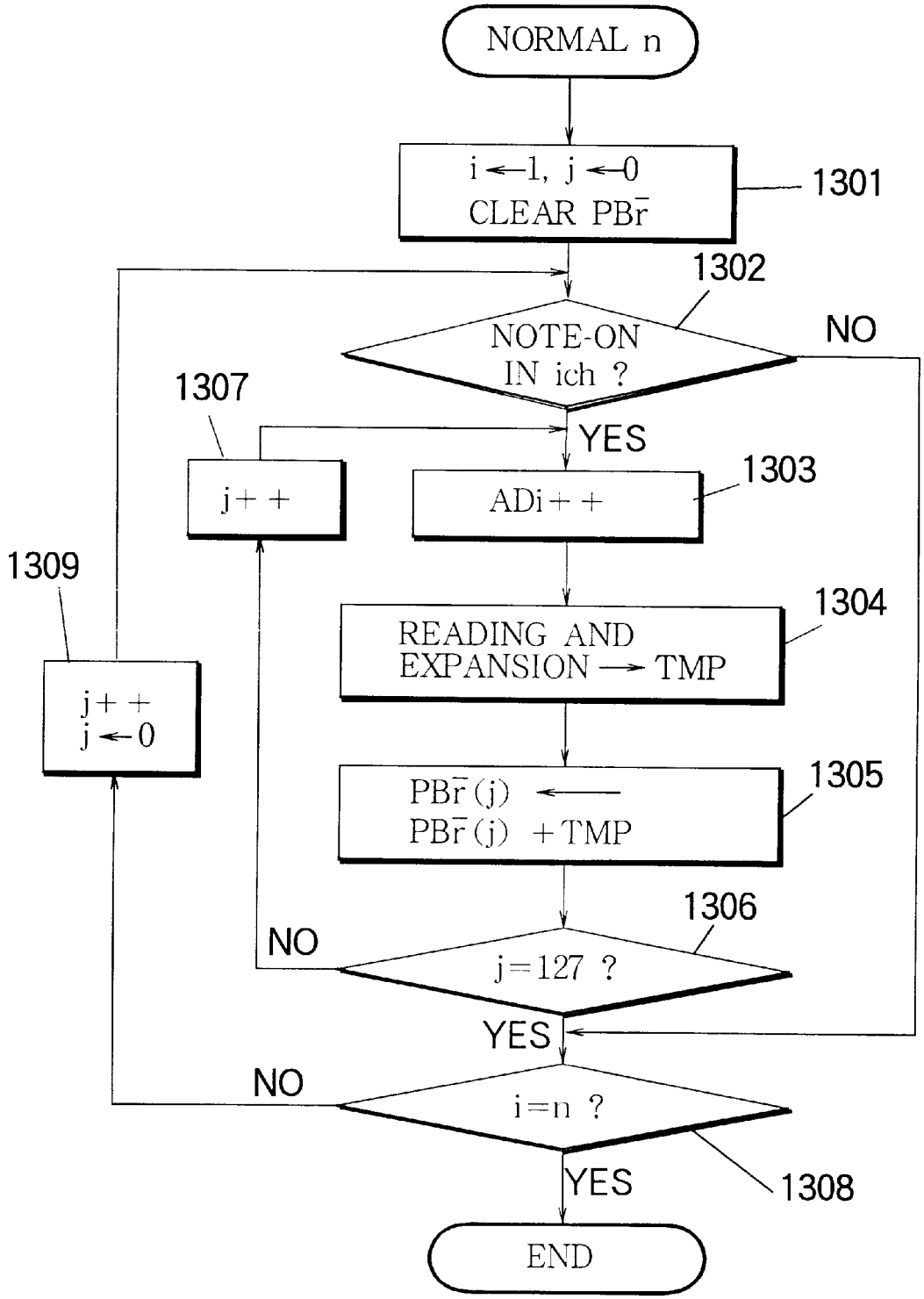
FIGS. 13(*a*) and 13(*b*) are flowcharts of subroutines "normal n" and "pitch 2".
Figure 13B:
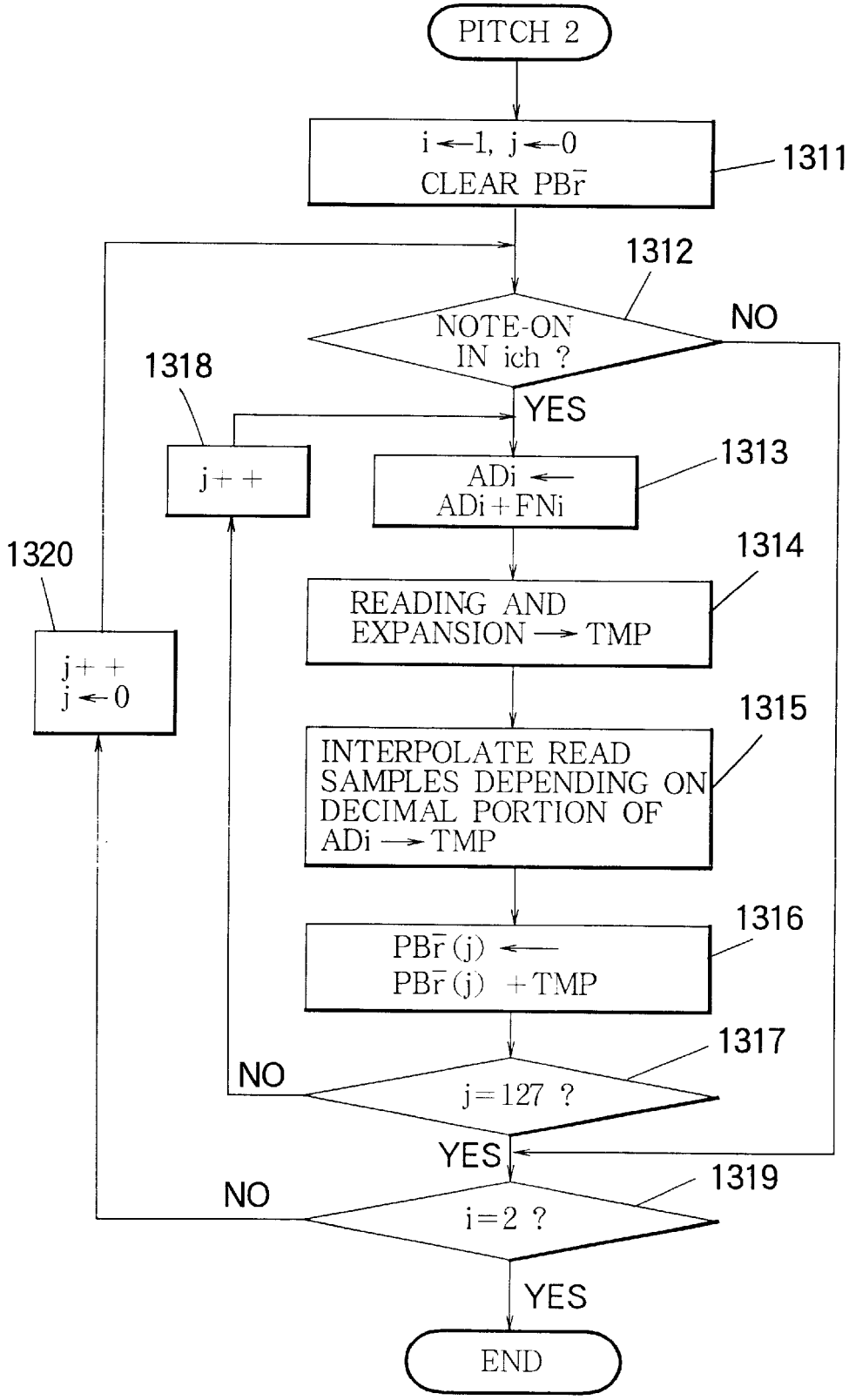

FIG. 13(*a*) shows a flowchart of the normal n. The normal 4 is called at the foregoing step 1101, while the normal 2 is called at the foregoing steps 1111 and 1201. First at step 1301, a work register i for counting the channels is set to 1, a work register j for counting the samples is set to 0, and all the sample region of the reproducing buffer PB$\bar{r}$ which is not currently subjected to the DP routine are cleared to 0. Then at step 1302, it is determined whether the note-on is written in the sound source register ich of the i-th channel. If the note-on is not written, it is not necessary to perform the waveform generation of the i-th channel. Thus, the routine proceeds to step 1308. If the i-th channel is subjected to the note-on event at step 1302, the routine proceeds to step 1303.

At step 1303, the reading address ADi of the i-th channel (ADi is set in the sound source register ich of the i-th channel) is incremented. At step 1304, the waveform sample is read out from the address ADi via the i-th channel, and the read waveform sample is ADPCM-expanded to derive a linear waveform sample which is then set in the work register TMP. Subsequently, at step 1305, the value of the register TMP is accumulated (channel accumulation) in the reproducing buffer PB$\bar{r}$(j) as represented by PB $\bar{r}$(j)+TMP→PB$\bar{r}$(j).

Then at step 1306, it is determined whether the count of the register j reaches 127. If the register j does not reach 127, the register j is incremented at step 1307 and the routine returns to step 1303 so as to repeat reading of the next waveform sample, the expansion and the accumulation. If the count of the register j becomes 127 at step 1306, meaning that the accumulation or summing-up of the 128 samples of the i-th channel is finished in the region assigned to the 128 samples of the reproducing buffer PB$\bar{r}$, the routine proceeds to step 1308.

At step 1308, it is determined whether the register i reaches n. If the register i does not reach n, the register i is incremented and the register j is cleared to 0 at step 1309 for commencing the waveform processing of the next channel. Then, the routine returns to step 1302 to repeat the processes relative to the i-th channel. If the register i reaches n at step 1308, meaning that the summing-up computation in the last channel is finished and 128 samples are produced in the reproducing buffer PB$\bar{r}$, the process is finished.

FIG. 13(*b*) is a flowchart of the "pitch 2" subroutine which is called at step 1121 in FIG. 11(*c*). At step 1311, the work register j for counting the channels is set to 1, the work register j for counting the samples is set to 0, and all the sample regions of the reproducing buffer PB$\bar{r}$which is not currently subjected to the DP routine are cleared to 0. Then at step 1312, it is determined whether the note-on is written to the sound source register ich of the i-th channel. If the note-on is not written, it is not necessary to perform the pitch-shifted waveform generation of the i-th channel. Thus, the routine proceeds to step 1319. If the i-th channel is subjected to the note-on event at step 1312, the routine proceeds to step 1313.

At step 1313, the waveform sample reading address ADi is added with the F number FNi so as to set a new address ADi. ADi and FNi are set in the sound source register ich of the i-th channel. Then, at step 1314, the waveform sample is read out from the address ADi via the i-th channel, and is ADPCM-expanded to derive the linear waveform sample which is then set in the work register TMP. Since the read waveform data is ADPCM-compressed, if an integer portion of the address ADi advances by no less than 2 as the result of the addition of the F number, all the samples from the last reading address to the current reading address ADi are read out and used for the linear expansion. Subsequently, at step 1315, the interpolation among the read samples is performed depending on a decimal portion of the address ADi, and the interpolated waveform sample is set in the register TMP. Then, at step 1316, the derived waveform sample TMP is accumulated in the j-th sample region PB$\bar{r}$(j) of the reproducing buffer.

Figure 14:
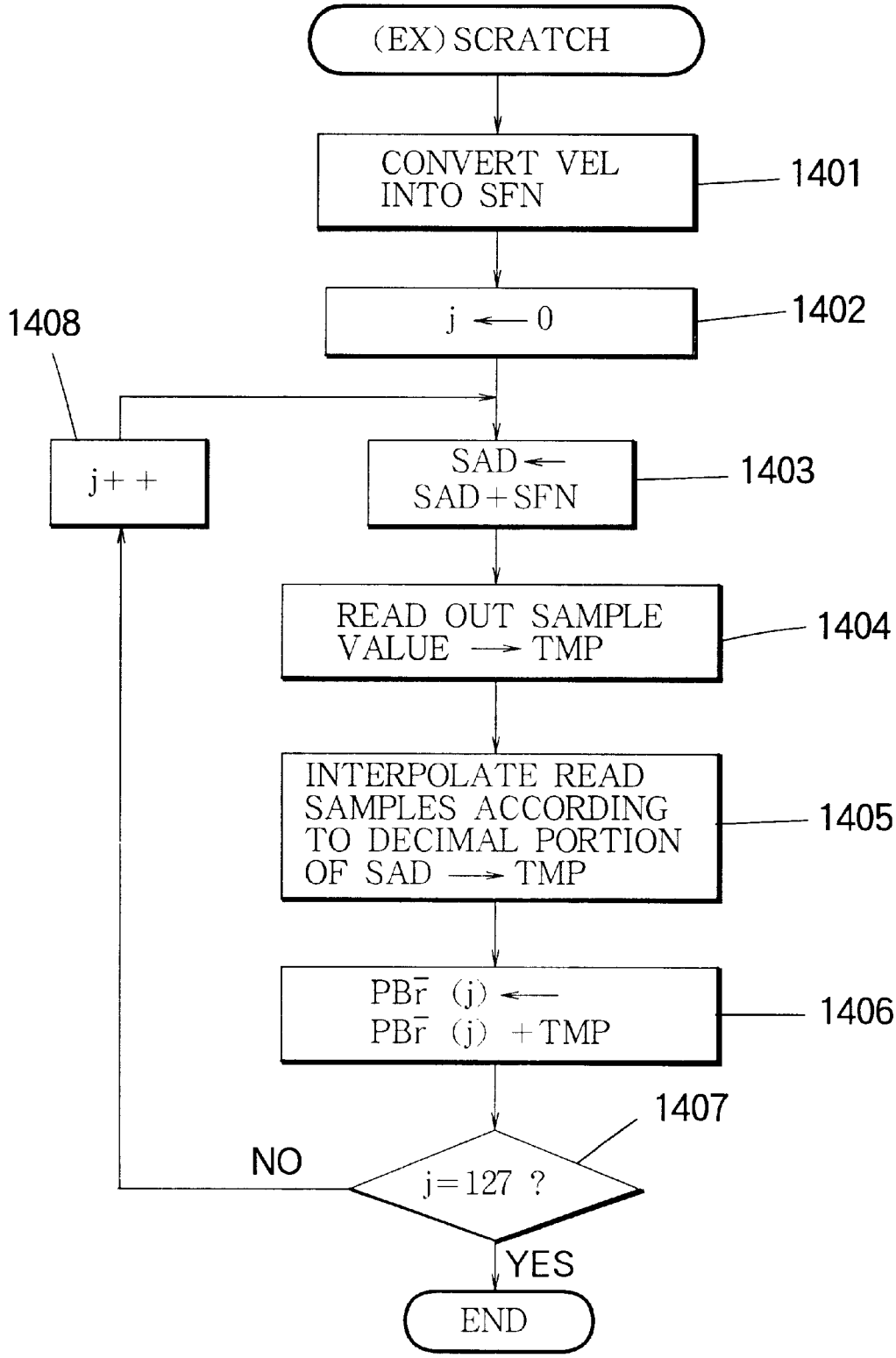
FIG. 14 is a flowchart of a scratch process and an EX scratch process.

Then, at step 1317, it is determined whether the register j reaches 127. If not, the register j is incremented at step 1318 and the routine returns to step 1313 so as to perform the processes relative to the next sample. If the register j reaches 127 at step 1317, meaning that the process for the i-th channel is finished, step 1319 determines whether the register i reaches 2. If the register i does not reach 2, the register i is incremented and the register j is cleared to 0 at step 1320, and then the routine returns to step 1312 so as to perform the processes relative to the next channel. If the value of the register i reaches 2 at step 1319, the process is finished. FIG. 14 is a flowchart of the scratch process which is called at step 1202 in FIG. 12(*a*) and the EX scratch process which is called at step 1222 in FIG. 12(*c*). First at step 1401, the detected touch action velocity VEL (VEL is provided in the sound source register sch of the scratch channel) of the ribbon controller 106 is converted into a variable F number SFN for the scratch operation. Since the F number SFN is determined depending on the velocity VEL which may take either of a positive value and a negative value, the F number SFN also changes in the positive and negative directions. Next, the register j is cleared to 0 at step 1402, and the routine proceeds to step 1403.

At step 1403, the scratch F number SFN is added to the scratch reading address SAD which is set in the sound source register sch of the scratch channel. At step 1404, the waveform sample is read out from the address SAD, and is set in the register TMP. In the scratch process called at step 1202 in FIG. 12(*a*), the read waveform data is ADPCM-expanded and developed in a given region in advance, and the scratch region SR is set in the given region where the waveform data is developed (steps 604 and 605 in FIG. 6). On the other hand, in the EX scratch process called at step 1222 in FIG. 12(*c*), the waveform data composed of a sequence of linear samples are inputted from the external source 111 and are written alternately into the recording buffers SRB0 and SRB1, and the scratch region SR is set in either of the recording buffers SRB0 and SRB1 which is not subjected to writing of the waveform data at the time of starting of the operation of the ribbon controller 106 (step 1007 in FIG. 10). In either case, only the number of samples as required for the interpolation is read out at step 1404.

Next, at step 1405, the interpolation among the read samples is performed depending on a decimal portion of the address SAD, and the interpolated waveform sample is set in the register TMP. Then at step 1406, the waveform sample TMP is accumulated in the j-th sample region $PB\bar{r}(j)$ of the reproducing buffer $PB\bar{r}$ to produce the absolute sample value represented by $PB\bar{r}$+TMP. Next, at step 1407, it is determined whether the register j reaches 127. If the register j does not reach 127, the register j is incremented at step 1408 and the routine returns to step 1403 so as to perform the processes relative to the next sample. If the register j reaches 127 at step 1407, the process is finished.

FIG. 15 is a flowchart of the DR(m) routine executed by the DMA controller 113 per sampling clock Fs generated by the Fs clock generator 110. The recording is performed when mode m=1, 5 or 6. First at step 1501, the waveform sample is transferred from the input FIFO of the sound I/O 112 to the sample region PBk(RP) of the recording buffer PBk designated by the recording pointer RP. The original musical tone signal inputted into the A/D input terminal from the external source 111 is A/D converted and loaded into the input FIFO. When the mode m is the sampling mode (m=1), the linear waveform sample A/D converted by the A/D converter is ADPCM-compressed using the ADPCM compression function of the sound I/O 112, and the compressed waveform sample is transferred to the recording buffer RBk(RP) via the input FIFO. On the other hand, when the mode m is the EX filter mode (m=5) or the EX scratch mode (m=6), the linear waveform sample which is A/D converted and is not subjected to the ADPCM compression is transferred to the recording buffer PBk(RP) via the input FIFO. When m=6, the recording buffer SRBk(RP) is used instead of the recording buffer RBk(RP).

Subsequently, the recording pointer RP is incremented at step 1502. Step 1503 determines whether the recording buffer RBk (when m=6, SRBk, which is also applied hereinafter) is filled up. If not filled up, the process is finished. If the recording buffer RBk is filled up, k is inverted (if 0, then converted to 1 and, if 1, then converted to 0) at step 1504. The interruption is generated at step 1505, and the process is finished. This interruption is caused for requesting the CPU 101 to perform a process of writing the set of the waveform samples of the filled-up recording buffer ($RB\bar{k}$ at this time point) into the flash memory 103 so as to render the recording buffer vacant.

FIG. 16 is a flowchart of the DP routine executed by the DMA controller 113 per sampling clock Fs generated by the Fs clock generator 110. First at step 1601, the waveform sample PBr(PP) indicated by the reproducing pointer PP on the reproducing buffer PBr is transferred to the output FIFO of the sound I/O 112. As explained with reference to FIG. 1, the waveform sample stored in the output FIFO is D/A converted, and is then sent to the sound system 114 so as to sound the musical tone. Next, the reproducing pointer PP is incremented at step 1602. Step 1603 determines whether the last one of the samples of the reproducing buffer PBr is sent out.

If all the waveform samples of the reproducing buffer PBr are reproduced at step 1603, r is inverted (if 0, then converted to 1 and, if 1, then converted to 0) and the other reproducing buffer is selected to be read out next at step 1604. Then at step 1605, an interruption is generated for requesting next provision of the waveform samples to the CPU 101, and the process is finished. If, at step 1603, there remains the waveform sample on the reproducing buffer PBr which is not reproduced yet, the process is once finished.

Next, description is given on what timings the foregoing flowcharts are executed in the respective mode. First, the operation in the normal mode (m=0) will be explained. When the normal mode is designated by the user using the mode change-over switch, the register m is set to 0 in the foregoing mode SW event routine shown in FIG. 4. Since the normal mode start process MS(0) does not perform any significant process to be explained in particular, its flowchart is omitted. On the other hand, when the operation of executing the DP routine per sampling clock Fs is stopped by the EX scratch mode or the like, MS(0) restarts its operation.

During the initialization at step 301 in FIG. 3 or in the restarting process of the reproducing operation by means of the foregoing MS(0), the CPU 101 sets the sound source registers of all the channels in FIG. 2(*a*) to the note-off state, clears all the sample regions of the reproducing buffers PB0 and PB1 of FIG. 2(*c*) to 0, instructs the sound I/O 112 and the DMA controller 113 to perform the reproducing operation, and then starts the generation of the sampling clock Fs by the Fs clock generator 110. By this, the DMA controller 113 interrupts the CPU 101 per sampling clock Fs from the Fs clock generator 110 and executes the DP routine of FIG. 16 upon every interruption so as to start the operation of reproducing the waveform data in the reproducing buffer.

Figure 17A:
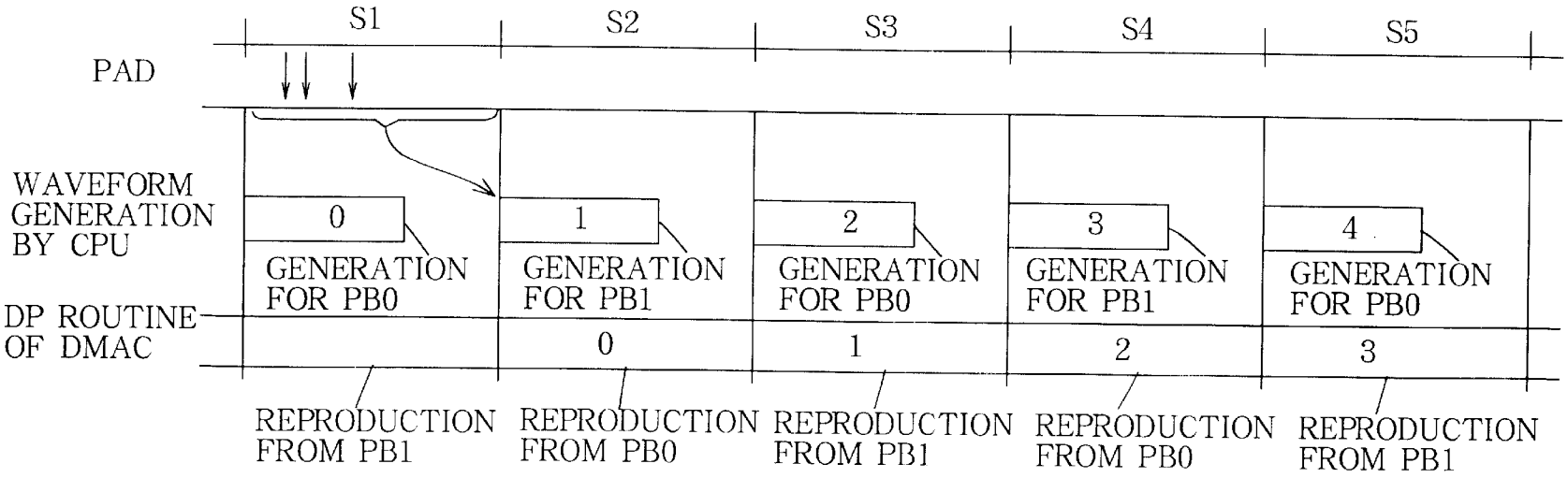
FIGS. 17(*a*) and 17(*b*) are diagrams showing timings of reproduction and recording of waveform data.
Figure 17B:
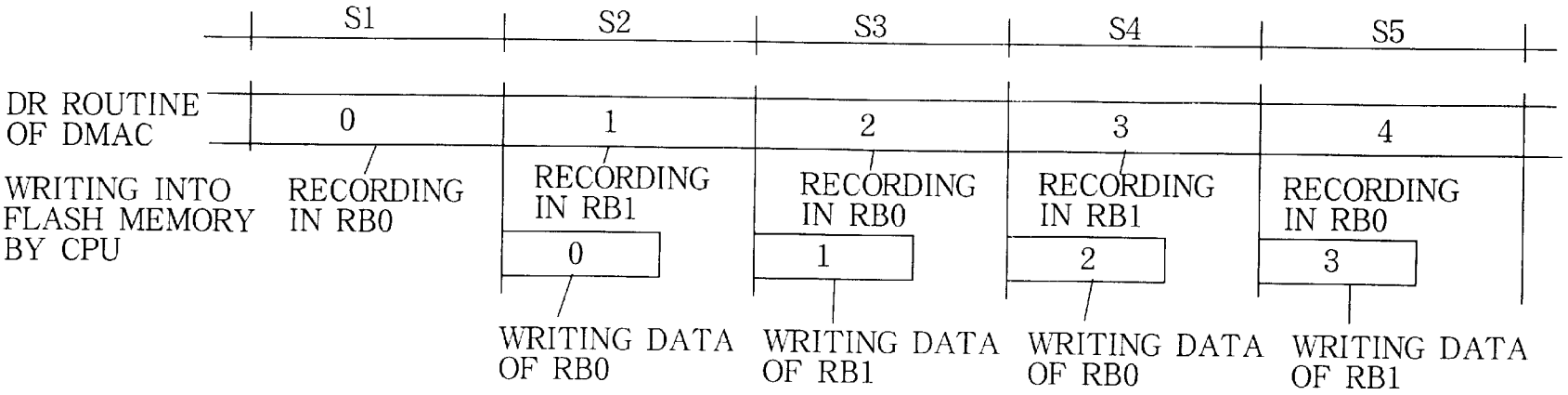

Now, a timing of process upon the reproduction will be explained. FIG. 17(*a*) shows a timing chart upon the reproduction. Each of sections S1 to S5 represents a frame for executing the reproduction of a set of the 128 samples. In the figure, "waveform generation by CPU" represents a section where the CPU 101 executes the waveform generation routine HS(0) of FIG. 11(*a*) so as to perform the process of generating 128 samples to be reproduced next in the reproducing buffer PB0 or PB1. On the other hand, "DP routine of DMAC" represents a section for performing the process of executing the DP routine so as to reproduce the waveform data in the reproducing buffer. The DP routine is executed per interruption depending on the sampling clock Fs, and the interruption takes place 128 times at a regular interval within one frame. Numerals 0 to 4 assigned to each of "waveform generation by CPU" and "DP routine of DMAC" are numerals assigned for convenience for indicating orders of the waveform generation and the reproduction.

In FIG. 17(*a*), first at section S1, the CPU 101 executes HS(0) and generates or produces the waveform data (128 waveform samples) for the reproducing buffer PB0. At subsequent section S2, the DMA controller 113 executes the DP routine based on the interruption per sampling clock Fs. By this, the 128 waveform samples of the reproducing buffer PB0 generated at section S1 are transferred to the output FIFO of the sound I/O 112 and reproduced in sequence at section S2. At the time point where all the 128 waveform samples of the reproducing buffer PB0 are transferred to the output FIFO of the sound I/O 112 (at termination of section S2), the interruption takes place (step 1605). Upon this interruption as a trigger, the CPU 101 executes the waveform generation routine HS(0) at section S3 and generates new waveform data (128 waveform samples) for the reproducing buffer PB0.

The foregoing explanation has been made only with respect to the reproducing buffer PB0. PB1 is also used alternately with PB0. To sum up, the DP routine is executed based on the interruption per sampling clock Fs so as to perform the reproduction of the waveform samples of PB0 and PB1 alternately with each other in such a manner: reproducing the waveform samples of PB1 at section S1, reproducing the waveform samples of PB0 at section S2, reproducing the waveform samples of PB1 at section S3, reproducing the waveform samples of PB0 at section S4, and so on. HS(0) is executed based on the interruption caused at the time point where the 128 samples are reproduced at each section, and the next 128 samples are produced for one of PB0 or PB1 which is currently idling. In view of the hierarchical structure of the software, the DP routine belongs to level 1, while HS(0) belongs to level 2. Thus, if an interruption is caused following sampling clock Fs while HS(0) is executed, the DP routine is executed with priority. By this, the reproduction by means of the DP routine and the waveform generation by means of the waveform generation routine HS(O) can be performed in parallel with each other.

If the pad is not depressed in the normal mode (m=0), all 0 samples in the reproducing buffer PB0, PB1 are repeatedly reproduced at timings explained with reference to FIG. 17(*a*). Because of the reproduction of all 0 samples, it is actually the same as a case where no musical tone is generated. The process will be explained wherein the pad is tapped in this state. As shown by arrows of "pad" in FIG. 17(*a*), it is assumed that the pad is set on at section S1. If the pad-on is detected in the general routine, the note-on of the waveform data corresponding to the set-on pad is written in the sound source register of FIG. 2(*a*) through the on-event routine of FIG. 7. The general routine or the on-event routine belongs to level 3 so as to be operated in parallel to the waveform generation routine HS(0) and the DP routine. The note-on written in the sound source register is treated for the reproducing buffer in the next execution of the HS(0).

Next, the operation in the sampling mode (m=1) will be explained. When the sampling mode is designated by the user using the mode change-over switch, the register m is set to 1 in the foregoing mode SW event routine of FIG. 4. Further, the sampling mode start process MS(1) is executed as shown in FIG. 5. In MS(1), the DP routine is stopped and the sound I/O 112 and the DMA controller 113 are instructed to perform the recording operation. By this, the DMA controller 113 interrupts the CPU 101 per sampling clock Fs fed from the Fs clock generator 110 and executes the DR(1) routine of FIG. 15 upon every interruption so as to start the operation of recording the waveform sample from the external source into the recording buffer.

Now, the timing of the process upon recording will be explained. FIG. 17(*b*) shows a timing chart upon recording. Each of sections S1 to S5 represents a frame for executing the recording of a set of 128 samples. In the figure, "DR routine of DMAC" represents a section for performing a recording process of executing the DR(1) routine so as to write the waveform samples of the input FIFO of the sound I/O 112 into the recording buffer. The waveform sample is obtained by A/D converting the external input signal and is ADPCM-compressed. The DR(1) routine is executed based on the interruption per sampling clock Fs, and this interruption is generated 128 times at a regular interval within on frame. In the figure, "writing into flash memory by CPU" represents a section for performing a process where the CPU 101 writes the waveform samples of the recording buffer RB0 or RB1 into the flash memory 103 so as to render the recording buffer vacant at step 509 in FIG. 5. Numerals 0 to 4 assigned to each section are numerals assigned for convenience for indicating orders of the recording and the writing into the flash memory.

In FIG. 17(*b*), first at section S1, the interruption is caused per sampling clock Fs and the DMA controller 113 executes the DR(1) routine upon every interruption. By this, the waveform samples of the input FIFO of the sound I/O 112 are written into the recording buffer RB0 in sequence. At the time point where the 128 waveform samples are written into the recording buffer RB0 at termination of section S1, an interruption takes place (step 1505). Upon this interruption as a trigger, the CPU 101 writes the waveform samples of the recording buffer RB0 into the flash memory 103 at section S2 (step 509) so as to render the recording buffer RB0 vacant.

The foregoing explanation has been made only with respect to the recording buffer RB0. RB1 is also used alternately with RB0. To sum up, the DR(1) routine is executed based on the interruption per sampling clock Fs so as to perform the recording or writing of the waveform samples into RB0 and RB1 alternately with each other according to the sampling clock Fs in such a manner: recording the waveform samples into RB0 at section S1, recording the waveform samples into RB1 at section S2, recording the waveform samples into RB0 at section S3, and so on. Based on the interruption caused at the time point where 128 samples are recorded in each section, the waveform samples of the recording buffer which completes the recording are written into the flash memory 103. In view of the hierarchical structure of the software, the DR(1) routine belongs to level 1, while MS(1) belongs to level 3. Thus, if an interruption is caused following sampling clock Fs while MS(1) is executed, the DR(1) routine is executed with priority. By this, the recording by means of the DR(1) routine and the writing into the flash memory 103 by means of MS(1) can be performed in parallel with each other.

Next, the operation in the filter mode (m=2) will be explained. When the filter mode is designated by the user using the mode change-over switch, the register m is set to 2 in the foregoing mode SW event routine shown in FIG. 4. Since the filter mode start process MS(2) does not perform any significant process to be explained in particular, its flowchart is omitted. On the other hand, when the operation of executing the DP routine per sampling clock Fs is stopped by the EX scratch mode or the like, MS(2) restarts its reproducing operation likewise the normal mode start process MS(0).

The filter mode performs the reproduction in a manner essentially the same as that of the normal mode. The DP routine is executed per sampling clock Fs and all 0 samples in the reproducing buffer PB0, PB1 are repeatedly reproduced while the pad-on is not achieved, which are the same as in the normal mode, and a processing procedure upon pad-on is also the same. Further, the timing upon reproduction is also the same as in FIG. 17(*a*). However, in the filter mode, the RC take-in routine RC(2) of FIG. 9 is executed each given timing based on the timer interruption so as to take in the detection value of the ribbon controller 106, and HS(2) of FIG. 11(*b*) is set, instead of HS(0), as the waveform generation process of the CPU 101 in FIG. 17(*a*). In the waveform generating routine HS(2), the waveform samples of at most two tones based on the pad-on are accumulated in the reproducing buffer, and the filter process is performed with the filter coefficient depending on the detection value RD of the ribbon controller 106 relative to the waveform samples of the reproducing buffer (steps 1112 and 1113). In the foregoing fashion, the filter control of the reproduced tone by the ribbon controller 106 is performed.

In the filter mode, the number of tone generations is reduced from four of the normal mode to two. In place of the reduction in number of the generated musical tones, the filter process is applied to the reproduced waveform. Since a given number of tone generations should be performed within a one-frame time, although the four tones can be generated in the normal mode, a process time becomes insufficient when the filter process is applied to the generated tones. In this regard, the number of tone generations is reduced to two so as to shorten the process time for the waveform generation, while the additional filter process is performed in a remaining time.

Next, the operation in the pitch mode (m=3) will be explained. When the pitch mode is designated by the user using the mode change-over switch, the register m is set to 3 in the foregoing mode SW event routine shown in FIG. 4. Since the pitch mode start process MS(3) does not perform any specific process to be explained in particular, its flowchart is omitted. On the other hand, when the operation of executing the DP routine per sampling clock Fs is stopped by the EX scratch mode or the like, MS(3) restarts its reproducing operation likewise the normal mode start process MS(0).

The pitch mode performs the tone reproduction in a manner essentially the same as that of the normal mode. The DP routine is executed per sampling clock Fs and all 0 samples in the reproducing buffer PB0, PB1 are repeatedly reproduced while the pad-on is not achieved, which are the same as in the normal mode, and a processing procedure upon pad-on is also the same. Further, the timing upon reproduction is also the same as in FIG. 17(*a*). However, in the pitch mode, the pad-on event routine of FIG. 8 is used instead of that of FIG. 7, and the waveform generating routine of HS(3) of FIG. 11(*c*) is used instead of that of HS(0) of FIG. 11(*a*). In the pad-on event routine of FIG. 8, the F number FNi corresponding to the pad number PN is generated. In the waveform generating routine HS(3) of FIG. 11(*c*), the waveform sample is read out using the address which is the sum of the F number FNi and the address ADi so as to change the reading speed. By this, the reproduction with a desired pitch can be achieved.

In the pitch mode, the number of tone generations is reduced from four of the normal mode to two. In place of the reduction in number of the generated musical tones, the pitch shift process is applied to the reproduced waveform. Since a given number of tone generations should be performed within a one-frame time, although four tones can be generated in the normal mode, a process time becomes insufficient when the pitch shift process is applied to the generated tones. In this regard, the number of tone generations is reduced to two so as to shorten a process time for the waveform generation, and the pitch shift process is performed in a remaining time.

Next, the operation in the scratch mode (m=4) will be explained. When the scratch mode is designated by the user using the mode change-over switch, the register m is set to 4 in the foregoing mode SW event routine shown in FIG. 4. In the scratch mode start process MS(4), the waveform data to be scratch-reproduced is developed in the given region and the scratch region SR and the scratch pointer SP are set in advance. Although not shown in FIG. 6, when the operation of executing the DP routine per sampling clock Fs is stopped by the EX scratch mode or the like, MS(4) restarts its operation likewise the normal mode start process MS(0).

In the scratch mode, the reproduction of the two tones caused by the pad-on is performed in a procedure essentially the same as that of the normal mode. The DP routine is executed per sampling clock Fs and all 0 samples in the reproducing buffer PB0, PB1 are repeatedly reproduced while the pad-on is not achieved, which are the same as in the normal mode, and a processing procedure upon pad-on is also the same. Further, the timing upon reproduction is also the same as in FIG. 17(*a*). However, in the scratch mode, the RC take-in routine RC(4) of FIG. 10 is executed by the timer interruption so as to take in the detection value of the ribbon controller 106. The note-on is written in the sound source register sch of the scratch channel at the start of the operation. Further, the velocity VEL of the ribbon controller 106 is detected and written in the sound source register sch. The waveform generation process of the CPU 101 is set to HS(4) of FIG. 12(*a*) instead of HS(0). In the waveform generating routine HS(4), the generation of the waveform samples for the two tones caused by the pad-on is performed by the normal 2 subroutine likewise the normal mode. Further, using the scratch subroutine (FIG. 14), the waveform sample in the scratch region SR is read out using the address SAD derived by adding the F number SFN to the address SAD. The read waveform sample is accumulated in the reproducing buffer PB$\bar{r}$. By this, the scratch reproduction using the designated waveform data can be achieved in addition to the two tones caused by the pad-on.

In the scratch mode, the number of tone generations is reduced from four of the normal mode to two. In place of the reduction in number of the generated musical tones, the scratch tones are generated. Since a given number of tone generations should be performed within a one-frame time, although four tones can be generated in the normal mode, a process time becomes insufficient when the scratch tones are additionally generated. In this regard, the number of tone generations is reduced to two so as to shorten a process time for the waveform generation, and the scratch tones are generated by using the remaining time.

Next, the operation in the EX filter mode (m=5) will be explained. When the EX filter mode is designated by the user using the mode change-over switch, the register m is set to 5 in the foregoing mode SW event routine shown in FIG. 4. Although a flowchart of the EX filter mode start process MS(5) is omitted, MS(5) executes the starting process of the DR(5) routine. Specifically, the CPU 101 instructs the sound I/O 112 and the DMA controller 113 to interrupt the CPU 101 per sampling clock Fs fed from the Fs clock generator 110 and to execute the DR(5) routine of FIG. 15 upon every interruption so as to start the writing operation of the waveform samples from the external source into the recording buffer RBk. At this time, the operation of interrupting the CPU 101 per sampling clock Fs fed from the Fs clock generator 110 and of executing the DP routine of FIG. 16 upon every interruption to reproduce the waveform data in the reproducing buffer is not stopped. If the operation of executing the DP routine per sampling clock Fs is stopped by the EX scratch mode or the like, MS(5) restarts its operation likewise the normal mode start process MS(0). Specifically, DP and DR(5) are executed per sampling clock Fs. In this case, since DP and DR(5) are operated following the same sampling clock Fs, they operate synchronously so that the interruption at step 1605 of the DP routine and the interruption at step 1505 of the DR(5) routine take place at the identical timing. Upon the interruptions caused at the same timing as a trigger, the waveform generating routine HS(5) of FIG. 12(*b*) is executed. In the EX filter mode, the external input signal is not recorded substantially. The external input signal is taken in the DR(5) routine, but this is for filtering the taken-in waveform data. Thus, the writing of the signal into the flash memory 103 is not performed.

When the interruptions take place according to DP and DR(5) at the same timing as described above, 128 linear samples of the waveform data from the external source 111 are written in the recording buffer RB$\bar{k}$ while the reproducing buffer PB$\bar{r}$ is vacant. The waveform generating routine HS(5) performs the filtering process relative to the 128 waveform samples of the recording buffer RB$\bar{k}$ and sets the resultant 128 waveform samples in the reproducing buffer PB$\bar{r}$. The RC take-in routine RC(5) of FIG. 9 is executed by the timer interruption so as to take in the detection value RD of the ribbon controller 106. The filter coefficient of the filtering process is determined depending on the detection value RD. In the foregoing fashion, the external input signal is filter-controlled by the ribbon controller 106 so as to output a modified musical tone with desired timbre variation.

Next, the operation in the EX scratch mode (m=6) will be explained. When the EX scratch mode is designated by the user using the mode change-over switch, the register m is set to 6 in the foregoing mode SW event routine shown in FIG. 4. Although a flowchart of the EX scratch mode start process MS(6) is omitted, MS(6) executes the following process. Specifically, the CPU 101 instructs the sound I/O 112 and the DMA controller 113 to interrupt the CPU 101 per sampling clock Fs fed from the Fs clock generator 110, and to execute the DP routine of FIG. 16 upon every interruption so as to stop the operation of reproducing the waveform samples in the reproducing buffer PBr. Further, the CPU instructs the sound I/O 112 to directly connect between the A/D input and the D/A output and to directly feed the musical tone signal from the external source 111 to the sound system 114 so as to emit sound. Further, the CPU 101 instructs the sound I/O 112 and the DMA controller 113 to interrupt the CPU 101 per sampling clock Fs from the Fs clock generator 110 and to execute the DR(6) routine of FIG. 15 upon every interruption so as to start the operation of writing the waveform sample from the external source into the recording buffer SRBk. In the EX scratch mode, the external input signal is not recorded substantially. The external input signal is taken by the DR(6) routine, but the taken-in waveform data is used for the scratch reproduction. Thus, the writing of the data into the flash memory 103 is not performed. Further, since the timer interruption is set effective during the initialization at step 301, the RC take-in routine RC(6) of FIG. 10 is executed per a given timing based on the timer interruption by the timer 105.

While the ribbon controller 106 is not operated, the process is finished through steps 1001→1002→1003→END in RC(6) of FIG. 10 so that the process of directly feeding the external input signal to the sound system 114 is continued. Further, since the DR(6) routine is executed based on the interruption per sampling clock Fs, the linear waveform samples obtained by A/D converting the external input signal are written into the recording buffers SRB0 and SRB1 alternately via the input FIFO.

When the operation of the ribbon controller 106 is started such as the finger or the like is in touch with the ribbon controller 106, the routine proceeds through steps 1001→1002→1004→1005 in RC(6). At next step 1006, the CPU 101 instructs the DMA controller 113 to stop the execution of the DR(6) routine by interrupting the CPU 101 per sampling clock Fs and sets the scratch region SR in the recording buffer SRB$\bar{k}$ which is one of the two recording buffers SRB0 and SRB1 not currently subjected to the writing, as described with reference to FIG. 2(*e*). Next, the predetermined value of the scratch pointer SP is set as the initial reading address SAD at step 1007. Further, at step 1008, 128 samples to be reproduced first are generated for the reproducing buffer PBr, and the CPU instructs the DMA controller 113 to restart the execution of the DR routine by interrupting the CPU per sampling clock Fs. Further, the interruption of the same significance as the interruption caused at step 1605 of the DP routine in FIG. 16 is generated. By this interruption, HS(6) is executed, and 128 samples to be scratched next are generated in PB$\bar{r}$. Further, under the command from the CPU 101, the direct connection from the A/D input of the sound I/O 112 to the D/A output is cut so as to stop feeding of the musical tone signal directly from the external source 111 to the sound system 114.

Further, if the finger or the like moves while being in touch with the ribbon controller 106, the routine proceeds from step 1004 to step 1011 so that the velocity VEL is detected and set in the sound source register sch. On the other hand, in the DP routine which is executed based on the interruption per sampling clock Fs, the reproducing buffers PB0 and PB1 are alternately accessed successively. Accordingly, the reproduction of the scratch tone is started based on the sound source register sch from the time point where the operation of the ribbon controller 106 is commenced. In particular, in the waveform generating routine HS(6) of FIG. 12(*c*) which is triggered by the interruption at step 1605 of the DP routine, since RS=1 is held while the operation of the ribbon controller 106 is performed, the routine proceeds from step 1221 to step 1222 so that the EX scratch process of FIG. 14 is executed. In the EX scratch process of FIG. 14, the waveform sample in the scratch region SR is read out using the address SAD derived by adding the F number SFN, which depends on the detected velocity VEL, to the address SAD and set in the reproducing buffer PB$\bar{r}$. Although it appears that the accumulation of the read data is performed at step 1406, since all 0 samples are set in PBr, the waveform samples TMP to be scratched are substantially set in PB$\bar{r}$. In the foregoing arrangement, the scratch reproduction using the waveform data inputted from the external source is achieved.

Figure 18B:
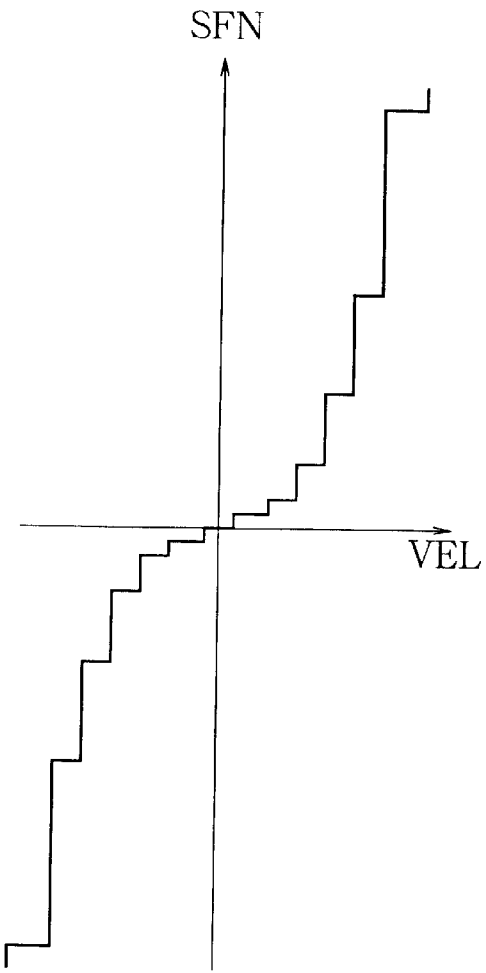
FIGS. 18(*a*) and 18(*b*) are diagrams showing examples of conversion from velocity VEL to scratch F number SFN.
Figure 18A:
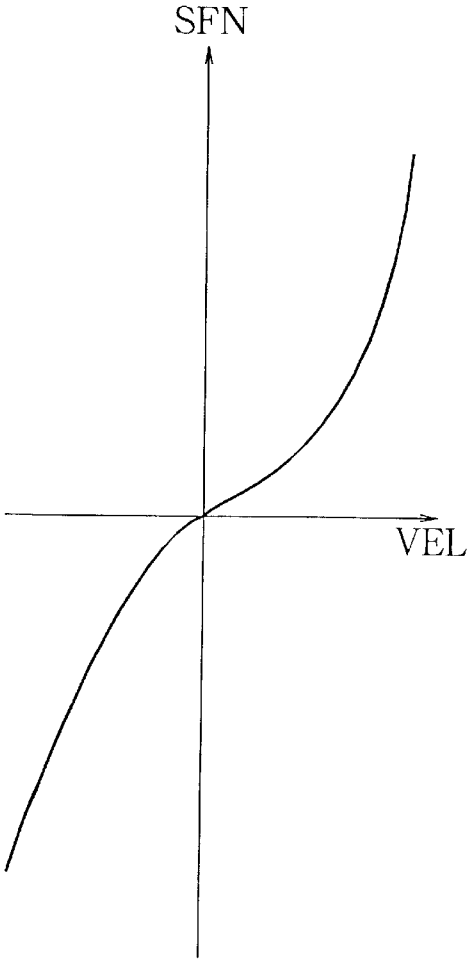

FIGS. 18(*a*) and 18(*b*) show examples of conversion from the velocity VEL to the scratch F number SFN performed at step 1401 in FIG. 14. This conversion may be achieved through calculation or by means of a table. FIG. 18(*a*) shows an example wherein a variation of the F number SFN increases as an absolute value of the velocity VEL increases. This realizes the scratch effect such a manner that a pitch variation is significant even when the length of the ribbon controller 106 is small.

Since the precise pitch control is not required in the reproduction of the scratch, the number of bits at a decimal portion of the scratch address SAD may be reduced if necessary. Specifically, the number of bits at a decimal portion of the address SAD derived at step 1403 in FIG. 14 may be reduced. This can reduce the calculation amount of interpolation performed at step 1405. Further, using a table shown in FIG. 18(*b*) upon conversion from the velocity VEL into the scratch F number SFN, the number of bits at the decimal portion of the F number SFN can be decreased to reduce the calculation amount of the interpolation.

Further, in the foregoing EX scratch mode, the waveform data fed from the external source is stored alternately into the recording buffers SRB0 and SRB1, and the scratch region is set in the recording buffer which is not subjected to writing at the time of starting the operation of the ribbon controller. On the other hand, it may be arranged that no less than three recording buffers are provided in which the waveform data is stored in turn in a ring fashion, and the scratch regions are set in a plurality of the recording buffers which are not subjected to writing at the time of starting the operation of the ribbon controller. With this arrangement, since the scratch regions are set in the plurality of recording buffers, the scratch region capacity sufficient for the scratch can be ensured. Further, since the capacity of each of the recording buffers can be set small, the data amount on the recording buffers which are subjected to writing at the time of starting the operation of the ribbon controller is decreased. Thus, the data not used for the scratch can be reduced. Stated otherwise, discarded portion of the data can be saved.

In FIG. 17(*a*), the head timings of the pad-on detection section, the section of the waveform generation by the CPU and the execution section of the DP routine of DMAC are shown to coincide with each other. However, this is not necessarily required, and the respective sections may be offset from each other. This also applies to the timings upon recording shown in FIG. 17(*b*). Further, in FIG. 17(*a*), the CPU performs the waveform generation at the time point where the reproduction of the samples in one of the reproducing buffers is finished in the DP routine. On the other hand, it may be arranged that the number of remaining samples not reproduced is detected in the reproducing buffer. When the detected number becomes no more than a given value, new samples are generated in vacant portions. Accordingly, by adjusting timings of reproduction and generation of samples, the number of the reproducing buffers may be one or no less than three.

Figure 19:
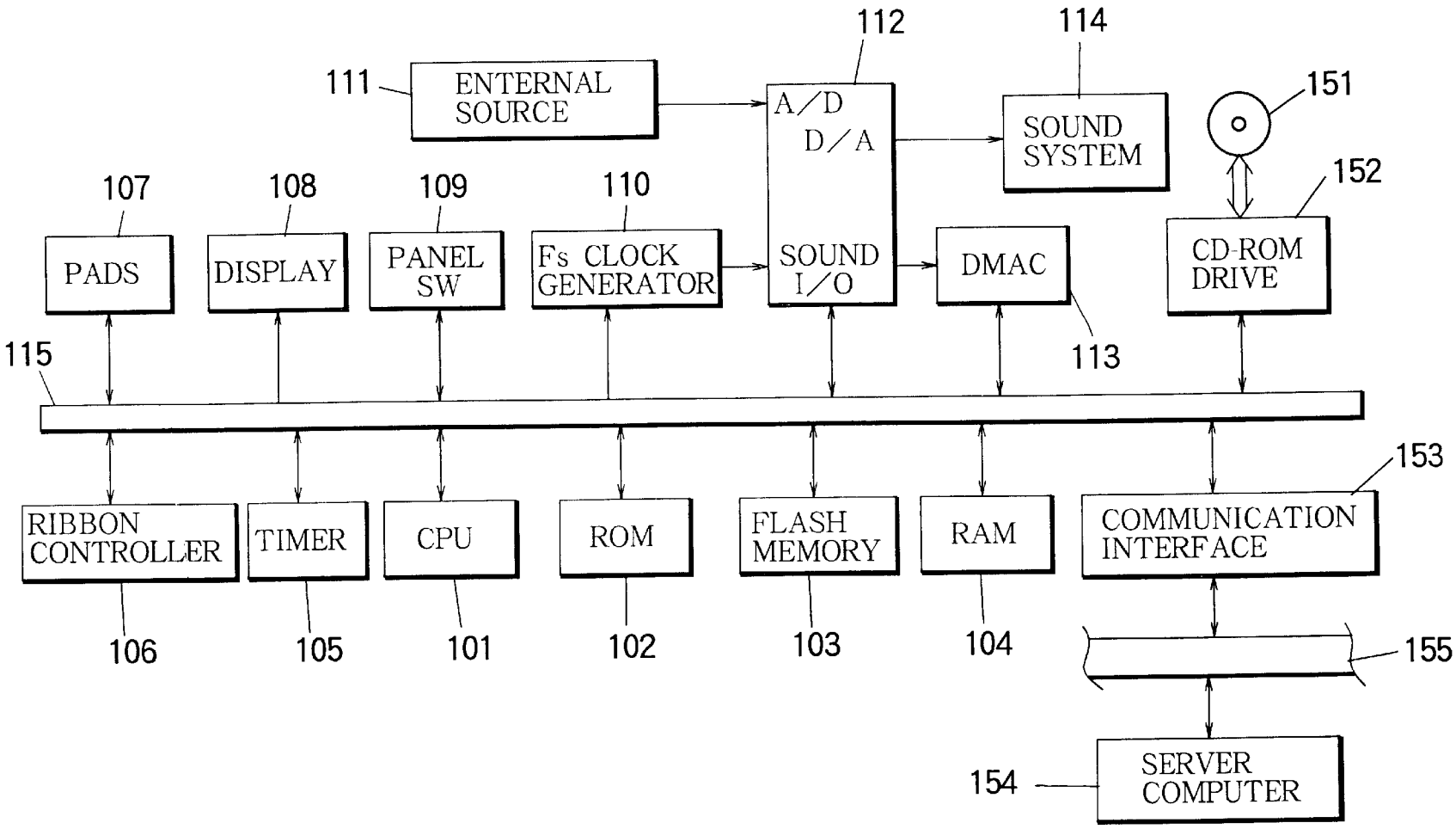
FIG. 19 is a schematic block diagram showing another embodiment of the invention.

FIG. 19 shows an additional embodiment of the inventive musical tone generating apparatus. This embodiment has basically the same construction as the first embodiment shown in FIG. 1. The same components are denoted by the same references as those of the first embodiment to facilitate better understanding of the additional embodiment. The storage such as ROM 102, RAM 104 and a hard disk (not shown) can store various data such as waveform data and various programs including the system control program or basic program, the waveform reading or generating program and other application programs. Normally, the ROM 102 provisionally stores these programs. However, if not, any program may be loaded into the apparatus. The loaded program is transferred to the RAM 104 to enable the CPU 101 to operate the inventive system of the musical tone generating apparatus. By such a manner, new or version-up programs can be readily installed in the system. For this purpose, a machine-readable media such as a CD-ROM (Compact Disc Read Only Memory) 151 is utilized to install the program. The CD-ROM 151 is set into a CD-ROM drive 152 to read out and download the program from the CD-ROM 151 into the RAM 104 through the bus 115. The machine-readable media may be composed of a magnetic disk or an optical disk other than the CD-ROM 151.

A communication interface 153 is connected to an external server computer 154 through a communication network 155 such as LAN (Local Area Network), public telephone network and INTERNET. If the internal storage does not reserve needed data or program, the communication interface 153 is activated to receive the data or program from the server computer 154. The CPU 101 transmits a request to the server computer 154 through the interface 153 and the network 155. In response to the request, the server computer 154 transmits the requested data or program to the apparatus. The transmitted data or program is stored in the storage to thereby complete the downloading.

The inventive musical tone generating apparatus can be implemented by a personal computer which is installed with the needed data and programs. In such a case, the data and programs are provided to the user by means of the machine-readable media such as the CD-ROM 151 or a floppy disk. The machine-readable media contains instructions for causing the personal computer to perform the inventive musical tone generating method as described in conjunction with the previous embodiments. Otherwise, the personal computer may receive the data and programs through the communication network 155.

As described above, according to the present invention, although the number of musical tones concurrently generated by the software sound source is reduced, the optional mode for performing the digital tone quality filter process, the pitch giving process or the scratch effect giving process is provided. Thus, the function which has not been achieved by the conventional software sound source can be realized so that the musical tone generation which meets various purposes of the user can be achieved.

Further, according to the invention, in the tone generating apparatus for reading the digital waveform data to reproduce a corresponding musical tone, the detecting implement is provided to detect the touch action of the user. The waveform data is read out according to modified reading addresses which are determined depending on the detected touch action. By such a manner, the inventive digital music apparatus can create the natural scratch effect which has been obtained only by the conventional analog music apparatus, in response to the user's touch action. Further, the waveform data is read out from a predetermined top address when the touch action is initiated. Thus, the waveform data is always retrieved from the predetermined top address wherever the user touches the scratch detecting implement. Thus, the same repeat scratch operation is realized by the invention as performed using an analog record disk in which a particular section of the record disk is repeatedly reproduced in synchronization with a rhythm of the music. Moreover, the outputs from the detecting implement are differentially processed to detect a velocity of the touch action. Then, the variable F number is determined according to the touch action. The F number is accumulated to the reading address for use in reading of the waveform data. By such a manner, a variation range of the F number can be expanded with a limited length of the linear detecting implement, thereby realizing wide scratch control. Additionally, according to the invention, the scratch effect can be applied to a fresh waveform which is inputted from an external source in real time basis. Thus, the user can scratch a desired section of the reproduced musical tone during the live performance of the music.

What is claimed is:

1. A computerized music apparatus installed with a program which is executed to perform reproduction of a musical tone by reading out a corresponding waveform, the apparatus comprising:

storage means for storing a plurality of waveforms corresponding to different musical tones, each waveform being stored in the form of a sequence of amplitude value data arranged at a given sampling period;

designating means for designating at least one of the stored waveforms to command reproduction of a corresponding one of the musical tones;

switching means operable for switching the reproduction of the musical tone between a normal mode and an optional mode;

processor means allotted with relatively high performance under the normal mode for concurrently reading out a number of the designated waveforms from the storage means according to the program so as to concurrently reproduce the number of the corresponding musical tones, otherwise the processor means being allotted with relatively low performance under the optional mode such that the number of the musical tones concurrently reproduced under the optional mode is reduced as compared to that under the normal mode while the processor means is allotted with additional performance under the optional mode for digitally processing the designated waveform to impart a specific sound effect to the reproduced musical tone according to the program, the processor means periodically executing the program at a first interval for reading out a section of the designated waveform; and output means for receiving the section of the designated waveform and being periodically operative at a second interval shorter than the first interval for sequentially outputting the received section of the designated waveform to reproduce the music tone.

2. A computerized music apparatus according to claim 1, wherein the switching means comprises means switchable between the normal mode and a filter optional mode such that the processor means operates under the filter optional mode for digitally processing the designated waveform by filtering to impart the specific sound effect.

3. A computerized music apparatus according to claim 1, wherein the switching means comprises means switchable between the normal mode and a pitch optional mode such that the processor means operates under the pitch optional mode for digitally processing the designated waveform by changing reading speed of the designated waveform to impart the specific sound effect.

4. A computerized music apparatus according to claim 1, wherein the switching means comprises means switchable between the normal mode and a scratch optional mode such that the processor means operates under the scratch optional mode for digitally processing the designated waveform by irregularly changing reading addresses of the designated waveform to impart the specific sound effect.

5. A computerized music apparatus according to claim 2, wherein the specific sound effect is a modification of a timbre of the reproduced musical tone.

6. A computerized music apparatus according to claim 3, wherein the specific sound effect is a modification of a pitch of the reproduced musical tone.

7. A computerized music apparatus according to claim 4, wherein the specific sound effect is to impart a scratch effect to the corresponding musical tone.

8. A computerized music apparatus according to claim 4, further comprising a scratch implement manipulated to input scratch operation so that the processor means operates under the scratch optional mode for changing the reading addresses of the designated waveform according to the inputted scratch operation.

9. A computerized music apparatus according to claim 3, further comprising pitch specifying means operable for specifying a pitch of a musical tone to be reproduced so that the processor means operates under the pitch optional mode to impart the pitch specified by the pitch specifying means to the reproduced musical tone.

10. A computerized music apparatus according to claim 9, wherein the designating means and the pitch specifying means comprise a common implement manually operable by the user such that the common implement is used as the designating means for designating the waveform under the normal mode while the common implement is used as both of the designating means for designating the waveform and the pitch specifying means for specifying the pitch of the musical tone corresponding to the designated waveform.

11. A computerized music apparatus installed with a program which is executed to perform reproduction of a musical tone by reading out a corresponding waveform, the apparatus comprising:

storage means for provisionally storing a plurality of waveforms corresponding to different musical tones, each waveform being stored in the form of a sequence of amplitude value data arranged at a given sampling period;

designating means for designating at least one of the stored waveforms to command reproduction of a corresponding one of the musical tones;

receiving means for receiving a fresh waveform on a real time basis when the fresh waveform is inputted from an external source;

switching means operable for switching the reproduction of the musical tone between a normal mode and an option made;

processor means operative under the normal mode for reading out the stored waveform designated by the designating means from the storage means according to the program so as to reproduce the musical tone corresponding to the designated waveform, otherwise the processor means being operative under the optional mode for suspending the reading of the stored waveform designated by the designating means and instead for processing the fresh waveform received by the receiving means so as to reproduce the musical tone corresponding to the fresh waveform such that a specific sound effect is imparted to the reproduced musical tone according to the program, the processor means periodically executing the program at a first interval for reading out a section of the designated waveform; and output means for receiving the section of the designated waveform and being periodically operative at a second interval shorter than the first interval for sequentially outputting the received section of the designated waveform to reproduce the music tone.

12. A computerized music apparatus according to claim 11, wherein the processor means includes filtering means operative under the optional mode for processing the fresh waveform by digital filtering to thereby impart the specific sound effect.

13. A computerized music apparatus according to claim 11, wherein the processor means includes scratching means operative under the option mode for irregularly processing the fresh waveform to thereby impart the specific sound effect.

14. A computerized music apparatus according to claim 13, further comprising a scratch implement manipulated to input scratch operation so that the scratching means operates according to the inputted scratch operation for irregularly changing reading addresses of the fresh waveform which is temporarily stored after the same is received by the receiving means to thereby reproduce a musical tone with a scratch effect.

15. A computerized music apparatus according to claim 12, wherein the specific sound effect is a modification of a timbre of the reproduced musical tone.

16. A computerized music apparatus according to claim 13, wherein the specific sound effect is to impart a scratch effect to the reproduced musical tone.

17. A music apparatus for reproducing a musical tone by reading out a corresponding waveform according to a variable reading address so as to introduce a scratch effect into the reproduced musical tone in response to touch action, the music apparatus comprising:

storing means for storing a waveform in the form of a sequence of amplitude value data arranged at a given sampling period to represent a corresponding musical tone;

a detecting implement having a length to receive the touch action for detecting a point of the touch action along the length and for outputting a positional value corresponding to the detected point of the touch action;

retrieving means for periodically retrieving the positional value outputted from the detecting implement to monitor the touch action; and reproducing means for variably determining each reading address according to the retrieved ones of the positional values and for successively reading out the waveform from the storage means according to each determined reading address so as to reproduce the corresponding musical tone with the scratch effect, wherein the reproducing means comprises means operative when the touch action is initiated for starting to read out the waveform from a predetermined start reading address, and being operative during the course of the touch action for continuing to successively read out the waveform according to each determined reading address.

18. A music apparatus for reproducing a musical tone by reading out a corresponding waveform according to a variable reading address so as to introduce a scratch effect into the reproduced musical tone in response to touch action, the music apparatus comprising:

storing means for storing a waveform in the form of a sequence of amplitude value data arranged at a given sampling period to represent a corresponding musical tone;

a detecting implement having a length to receive the touch action for detecting a point of the touch action along the length and for outputting a positional value corresponding to the detected point of the touch action;

retrieving means for periodically retrieving the positional value outputted from the detecting implement to monitor the touch action; and reproducing means for variably determining each reading address according to the retrieved ones of the positional values and for successively reading out the waveform from the storage means according to each determined reading address so as to reproduce the corresponding musical tone with the scratch effect, wherein the retrieving means comprises means for differentially processing the periodically retrieved positional values to compute a velocity of the touch action, and wherein the reproducing means comprises means for determining a variable number according to the velocity of the touch action and for accumulating the variable number to a preceding reading address to determine a succeeding reading address.

19. A method of operating a computerized music apparatus installed with a program which is executed to perform reproduction of a musical tone by reading out a corresponding waveform, the method comprising the steps of:

storing a plurality of waveforms corresponding to different musical tones in a storage, each waveform being stored in the form of a sequence of amplitude value data arranged at a given sampling period;

designating at least one of the stored waveforms to command reproduction of a corresponding one of the musical tones;

switching the reproduction of the musical tone between a normal mode and an optional mode;

performing a first reproduction with relatively high performance under the normal mode for concurrently reading out a number of the designated waveforms from the storage according to the program so as to concurrently reproduce the number of the corresponding musical tones;

otherwise performing a second reproduction with relatively low performance under the optional mode such that the number of the musical tones concurrently reproduced under the optional mode is reduced as compared to that under the normal mode; and performing a third reproduction with additional performance under the optional mode for digitally processing the designated waveform to impart a specific sound effect to the corresponding musical tone according to the program;

periodically executing the program at a first interval for reading out a section of the designated waveform;

receiving the section of the designated waveform; and periodically operating at a second interval shorter than the first interval for sequentially outputting the received section of the designated waveform to reproduce the music tone.

20. The method of operating a computerized music apparatus according to claim 19, wherein the step of switching comprises switching between the normal mode and a filter optional mode such that the third reproduction is performed under the filter optional mode for digitally processing the designated waveform by filtering to impart the specific sound effect.

21. The method of operating a computerized music apparatus according to claim 19, wherein the step of switching comprises switching between the normal mode and a pitch optional mode such that the third reproduction is performed under the pitch optional mode for digitally processing the designated waveform by changing reading speed of the designated waveform to impart the specific sound effect.

22. The method of operating a computerized music apparatus according to claim 21, further comprising the step of specifying a pitch of a musical tone to be reproduced by the user so that the third reproduction is performed under the pitch optional mode to impart the pitch specified by the step of specifying the reproduced musical tone.

23. The method of operating a computerized music apparatus according to claim 19, wherein the step of switching comprises switching between the normal mode and a scratch optional mode such that the third reproduction is performed under the scratch optional mode for digitally processing the designated waveform by irregularly changing reading addresses of the designated waveform to impart the specific sound effect.

24. The method of operating a computerized music apparatus according to claim 23, further comprising the step of manipulating a scratch implement by the user to input scratch operation so that the third reproduction is performed under the scratch optional mode for changing the reading addresses of the designated waveform according to the inputted scratch operation.

25. A method of operating a computerized music apparatus according to claim 20, wherein the specific sound effect is a modification of a timbre of the corresponding musical tone.

26. A method of operating a computerized music apparatus according to claim 21, wherein the specific sound effect is a modification of a pitch of the corresponding musical tone.

27. A method of operating a computerized music apparatus according to claim 23, wherein the specific sound effect is to impart a scratch effect to the corresponding musical tone.

28. A method of operating a computerized music apparatus installed with a program which is executed to perform reproduction of a musical tone by reading out a corresponding waveform, the method comprising the steps of:

provisionally storing a plurality of waveforms corresponding to different musical tones in a storage, each waveform being stored in the form of a sequence of amplitude value data arranged at a given sampling period;

designating at least one of the stored waveforms to command reproduction of a corresponding one of the musical tones;

receiving a fresh waveform on a real time basis when the fresh waveform is inputted from an external source;

switching the reproduction of the musical tone between a normal mode and an optional mode;

performing a first reproduction under the normal mode for reading out the stored waveform designated by the step of designating from the storage according to the program so as to reproduce the musical tone corresponding to the designated waveform;

otherwise performing a second reproduction under the optional mode for suspending the reading of the stored waveform designated by the step of designating and instead for processing the fresh waveform received by the step of receiving so as to reproduce the musical tone corresponding to the fresh waveform such that a specific sound effect is imparted to the reproduced musical tone according to the program;

periodically executing the program at a first interval for reading out a section of the designated waveform;

receiving the section of the designated waveform; and periodically operating at a second interval shorter than the first interval for sequentially outputting the received section of the designated waveform to reproduce the music tone.

29. The method of operating a computerized music apparatus according to claim 28, wherein the second reproduction is performed under the optional mode for processing the fresh waveform by digital filtering to thereby impart the specific sound effect.

30. The method of operating a computerized music apparatus according to claim 28, wherein the second reproduction is performed under the optional mode for irregularly processing the fresh waveform to thereby impart the specific sound effect.

31. The method of operating a computerized music apparatus according to claim 30, further comprising the step of manipulating a scratch implement by the user to input scratch operation so that the second reproduction is performed according to the inputted scratch operation for irregularly changing reading addresses of the fresh waveform which is temporarily stored after the same is received to thereby reproduce a musical tone with a scratch effect.

32. The method of operating a computerized music apparatus according to claim 29, wherein the specific sound effect is a modification of a timbre of the produced musical tone.

33. The method of operating a computerized music apparatus according to claim 30, wherein the specific sound effect is to impart a scratch effect to the reproduced musical tone.

34. A method of operating a musical apparatus for reproducing a musical tone by reading out a corresponding waveform according to a variable reading address so as to introduce a scratch effect into the reproduced musical tone in response to touch action, the method comprising the steps of:

storing a waveform into a storage in the form of a sequence of amplitude value data arranged at a given sampling period to represent a corresponding musical tone;

operating a detecting implement having a length to receive the touch action for detecting a point of the touch action along the length and for outputting a positional value corresponding to the detected point of the touch action;

periodically retrieving the positional value outputted from the detecting implement to monitor the touch action; variably determining each reading address according to the retrieved ones of the positional values; and performing reproduction for successively reading out the waveform from the storage according to each determined reading address so as to reproduce the corresponding musical tone with the scratch effect, wherein the reproduction is performed when the touch action is initiated for starting to read out the waveform from a predetermined start reading address, and the reproduction is performed during the course of the touch action for continuing to successively read out the waveform according to each determined reading address.

35. The method of operating a music apparatus according to claim 34, wherein the step of retrieving comprises differentially processing the periodically retrieved positional values to compute a velocity of the touch action, and wherein the step of performing reproduction comprises determining a variable number according to the velocity of the touch action and accumulating the variable number to a preceding reading address to determine a succeeding reading address.

36. A method of operating a musical apparatus for reproducing a musical tone by reading out a corresponding waveform according to a variable reading address so as to introduce a scratch effect into the reproduced musical tone in response to touch action, the method comprising the steps of:

inputting a waveform from an external source continually;

storing the waveform into a storage in the form of a sequence of amplitude value data arranged at a given sampling period to represent a corresponding musical tone;

operating a detecting implement having a length to receive the touch action for detecting a point of the touch action along the length and for outputting a positional value corresponding to the detected point of the touch action;

periodically retrieving the positional value outputted from the detecting implement to monitor the touch action;

generating a reading address according to the retrieval positional value and successively reading out the waveform from the storage according to the reading address; and reproducing a musical tone according to the waveform, wherein when the touch action is not detected by the detecting implement, the step of storing the inputted waveform continues and the musical tone corresponding to the inputted waveform is reproduced without the scratch effect, and when the touch action is detected by the detecting implement, the step of storing is suspended and the musical tone corresponding to the waveform read out in the step of reading is reproduced with the scratch effect.

37. A machine-readable media containing a program for causing a computerized music apparatus to perform a method of reproducing a musical tone by reading out a corresponding waveform, the method comprising the steps of:

storing a plurality of waveforms corresponding to different musical tones in a storage, each waveform being stored in the form of a sequence of amplitude value data arranged at a given sampling period;

designating at least one of the stored waveforms to command reproduction of a corresponding one of the music tones;

providing a normal mode and an optional mode for the production of the musical tone;

performing a first reproduction with relatively high performance under the normal mode for concurrently reading out a number of the designated waveforms from the storage according to the program so as to concurrently reproduce the number of the corresponding musical tones;

otherwise performing a second reproduction with relatively low performance under the optional mode such that the number of the musical tones concurrently reproduced under the optional mode is reduced as compared to that under the normal mode;

performing a third reproduction with additional performance under the optional mode for digitally processing the designated waveform to impart a specific sound effect to the corresponding musical tone according to the program;

periodically executing the program at a first interval for reading out a section of the designated waveform;

receiving the section of the designated waveform; and periodically operating at a second interval shorter than the first interval for sequentially outputting the received section of the designated waveform to reproduce the music tone.

38. A machine-readable media according to claim 37, wherein the step of switching comprises switching between the normal mode and a filter optional mode such that the third reproduction is performed under the filter optional mode for digitally processing the designated waveform by filtering to impart the specific sound effect.

39. A machine-readable media according to claim 37, wherein the step of switching comprises switching between the normal mode and a pitch optional mode such that the third reproduction is performed under the pitch optional mode for digitally processing the designated waveform by changing reading speed of the designated waveform to impart the specific sound effect.

40. A machine-readable media according to claim 39, wherein the method further comprises the step of specifying a pitch of a musical tone to be reproduced by the user so that the third reproduction is performed under the pitch optional mode to impart the pitch specified by the step of specifying to the reproduced musical tone.

41. A machine-readable media according to claim 37, wherein the step of switching comprises switching between the normal mode and a scratch optional mode such that the third reproduction is performed under the scratch optional mode for digitally processing the designated waveform by irregularly changing reading addresses of the designated waveform to impart the specific sound effect.

42. A machine-readable media according to claim 41, wherein the method further comprises the step of providing a scratch implement for inputting scratch operation so that the third reproduction is performed under the scratch optional mode for changing the reading addresses of the designated waveform according to the inputted scratch operation.

43. A machine-readable media according to claim 38, wherein the specific sound effect is a modification of a timbre of the corresponding musical tone.

44. A machine-readable media according to claim 39, wherein the specific sound effect is a modification of a pitch of the corresponding musical tone.

45. A machine-readable media according to claim 41, wherein the specific sound effect is to impart a scratch effect to the corresponding musical tone.

46. A machine-readable media containing a program for causing a computerized music apparatus to perform a method of reproducing a musical tone by reading out a corresponding waveform, the method comprising the steps of:

provisionally storing a plurality of waveforms corresponding to different musical tones in a storage, each waveform being stored in the form of a sequence of amplitude value data arranged at a given sampling period;

designating at least one of the stored waveforms to command reproduction of a corresponding one of the musical tones;

receiving a fresh waveform on a real time basis when the fresh waveform is inputted from an external source;

providing a normal mode and an optional mode for the reproduction of the musical tone;

performing a first reproduction under the normal mode for reading out the stored waveform designated by the step of designating from the storage according to the program so as to reproduce the musical tone corresponding to the designated waveform;

otherwise performing a second reproduction under the optional mode for suspending the reading of the stored waveform designated by the step of designating and instead for processing the fresh waveform received by the step of receiving so as to reproduce the musical tone corresponding to the fresh waveform such that a specific sound effect is imparted to the reproduced musical tone according to the program;

periodically executing the program at a first interval for reading out a section of the designated waveform;

receiving the section of the designated waveform; and periodically operating at a second interval shorter than the first interval for sequentially outputting the received section of the designated waveform to reproduce the music tone.

47. A machine-readable media according to claim 46, wherein the second reproduction is performed under the option mode for processing the fresh waveform by digital filtering to thereby impart the specific sound effect.

48. A machine-readable media according to claim 46, wherein the second reproduction is performed under the optional mode for irregularly processing the fresh waveform to thereby impart the specific sound effect.

49. A machine-readable media according to claim 48, wherein the method further comprises the step of providing a scratch implement for inputting scratch operation so that the second reproduction is performed according to the inputted scratch operation for irregularly changing reading addresses of the fresh waveform which is temporarily stored after the same is received to thereby reproduce a musical tone with a scratch effect.

50. A machine-readable media according to claim 47, wherein the specific sound effect is a modification of a timbre of the reproduced musical tone.

51. A machine-readable media according to claim 48, the specific sound effect is to impart a scratch effect to the reproduced musical tone.

52. A machine-readable media containing instructions for causing a music apparatus to perform a method of reproducing a musical tone by reading out a corresponding waveform according to a variable reading address so as to introduce a scratch effect into the reproduced musical tone in response to touch action, the method comprising the steps of:

storing a waveform into a storage in the form of a sequence of amplitude value data arranged at a given sampling period to represent a corresponding musical tone;

operating a detecting implement having a length to receive the touch action for detecting a point of the touch action along the length and for outputting a positional value corresponding to the detected point of the touch action;

periodically retrieving the positional value outputted from the detecting implement to monitor the touch action;

variably determining each reading address according to the retrieved ones of the positional values; and performing reproduction for successively reading out the waveform from the storage according to each determined reading address so as to reproduce the corresponding musical tone with the scratch effect, wherein the reproduction is performed when the touch action is initiated for starting to read out the waveform from a predetermined start reading address, and the reproduction is performed during the course of the touch action for continuing to successively read out the waveform according to each determined reading address.

53. A machine-readable media according to claim 52, wherein the step of retrieving comprises differentially processing the periodically retrieved positional values to compute a velocity of the touch action, and wherein the step of performing reproduction comprises determining a variable number according to the velocity of the touch action and accumulating the variable number to a preceding reading address to determine a succeeding reading address.

54. A machine-readable media containing instructions for causing a music apparatus to perform a method of reproducing a musical tone by reading out a corresponding waveform according to a variable reading address so as to introduce a scratch effect into the reproduced musical tone response to touch action, the method comprising the steps of:

inputting a waveform from an external source continually;

storing the waveform into a storage in the form of a sequence of amplitude value data arranged at a given sampling period to represent a corresponding musical tone;

operating a detecting implement having a length to receive the touch action for detecting a point of the touch action along the length and for outputting a positional value corresponding to the detected point of the touch action;

periodically retrieving the positional value outputted from the detecting implement to monitor the touch action;

generating a reading address according to the retrieval positional value and successively reading out the waveform from the storage according to the reading address; and reproducing a musical tone according to the waveform, wherein when the touch action is not detected by the detecting implement, the step of storing the inputted waveform continues and the musical tone corresponding to the inputted waveform is reproduced without the scratch effect, and when the touch action is detected by the detecting implement, the step of storing is suspended and the musical tone corresponding to the waveform read out in the step of reading is reproduced with the scratch effect.

55. A music apparatus for reproducing a musical tone by reading out a corresponding waveform according to a variable reading address so as to introduce a scratch effect into the reproduced musical tone in response to touch action, the music apparatus comprising:

input means for inputting a waveform from an external source continually;

storing means for storing the waveform in the form of a sequence of amplitude value data arranged at a given sampling period to represent a corresponding musical tone into a storage means;

a detecting implement having a length to receive the touch action for detecting a point of the touch action along the length and for outputting a positional value corresponding the detected point of the touch action;

retrieving means for periodically retrieving the positional value outputted from the detecting implement to monitor the touch action;

reading means for generating an address according to the retrieved positional value and for successively reading out the waveform from the storage means according to the address; and reproducing means for reproducing a musical tone according to the waveform, wherein when the touch action is not detected by the detecting implement, the storing means continue to store the inputted waveform and the reproducing means reproduce the musical tone corresponding to the inputted waveform without the scratch effect, and when the touch action is detected by the detecting implement, the storing means suspends storing of the waveform and the reproducing means reproduce the musical tone corresponding to the waveform read out by the reading means with the scratch effect.

56. A music apparatus according to claim 55, wherein the storage means has a memory capacity sufficient to store a complete data volume of a fresh waveform newly inputted from the external source on a real time basis.

57. A computerized music apparatus, comprising:

a processor having a stored program that is executed to perform reproduction of a musical tone;

a memory device coupled to said processor including a plurality of waveforms corresponding to different musical tones, each waveform comprising a sequence of amplitude value data arranged at a given sampling period;

a plurality of pads electrically coupled to said processor, the plurality of pads each having a surface adapted to be tapped to designate through the processor at least one of the waveforms stored in said memory device to command reproduction of a corresponding one of the musical tones;

a switch electrically coupled to at least said plurality of pads and said processor, the switch being selectable between a first position corresponding to a normal mode of reproduction and a second position corresponding to an optional mode of reproduction, wherein the processor is allotted with relatively high performance under the normal mode selected by said switch thereby enabling the processor to concurrently read out a number of the designated waveforms from the memory device according to the program so as to concurrently reproduce the number of the corresponding musical tones, and the processor being allotted with relatively low performance under the optional mode selected by said switch such that the number of the musical tones concurrently reproduced under the optional mode is reduced as compared to that under the normal mode while the processor is allotted with additional performance under the optional mode and adapted to digitally process the designated waveform to impart a specific sound effect to the reproduced musical tone according to the program, the processor periodically executing the program at a first interval for reading out a section of the designated waveform; and a direct memory access controller electrically coupled to at least said processor and said memory device adapted to receive the section of the designated waveform from the memory device and being periodically operative at a second interval shorter than the first interval such that the received section of the designated waveform from the memory device is sequentially outputted to reproduce the music tone.

58. A computerized music apparatus, comprising:

a processor having a stored program that is executed to perform reproduction of a musical tone;

a memory device coupled to said processor including a plurality of waveforms corresponding to different musical tones, each waveform being provisionally stored in the form of a sequence of amplitude value data arranged at a given sampling period;

a plurality of pads electrically coupled to said processor, the plurality of pads each having a surface adapted to be tapped to designate through the processor at least one of the stored waveforms from said memory device to command reproduction of a corresponding one of the musical tones;

a sound input/output device coupled to an external source adapted to receive a fresh waveform on a real time basis when the fresh waveform is inputted from the external source;

a switch electrically coupled to at least said plurality of pads and said processor, the switch being selectable between a first position corresponding to a normal mode of reproduction and a second position corresponding to an optional mode of reproduction, wherein the processor is adapted to operate under the normal mode selected by said switch reading out the stored waveform designated by the plurality of pads from the memory device according to the program so as to reproduce the musical tone corresponding to the designated waveform, otherwise the processor being adapted to operate under the optional mode selected by said switch suspending the reading of the stored waveform designated by the plurality of pads and instead processing the fresh waveform received by the sound input/output device from the external source so as to reproduce the musical tone corresponding to the fresh waveform such that a specific sound effect is imparted to the reproduced musical tone according to the program, the processor adapted to periodically execute the program at a first interval reading out a section of the designated waveform; and a direct memory access controller electrically coupled to at least said processor adapted to receive the section of the designated waveform from said processor and being periodically operative at a second interval shorter than the first interval such that the received section of the designated waveform is sequentially outputted to reproduce the music tone.

59. A music apparatus for reproducing a musical tone by reading out a corresponding waveform according to a variable reading address so as to introduce a scratch effect into the reproduced musical tone in response to touch action, the music apparatus comprising:

a memory device including a waveform in the form of a sequence of amplitude value data arranged at a given sampling period to represent a corresponding musical tone;

a coordinate detecting device coupled to at least said memory device, having a length adapted to receive the touch action, detect a point of the touch action along the length, and output a positional value corresponding to the detected point of the touch action, wherein the touch action determines reading of the waveform from the memory device; and a processor electrically coupled to at least said memory device and said coordinate detecting device, the processor adapted to periodically retrieve the positional value outputted from the coordinate detecting device to monitor the touch action, and to variably determine each reading address according to the retrieved ones of the positional values and successively read out the waveform from the memory device according to each determined reading address so as to reproduce the corresponding musical tone with the scratch effect, wherein the processor starts to read out the waveform from a predetermined start reading address when the touch action is initiated, and continues to successively read out the waveform according to each determined reading address during the course of the touch action.

60. A music apparatus for reproducing a musical tone by reading out a corresponding waveform according to a variable reading address so as to introduce a scratch effect into the reproduced musical tone in response to touch action, the music apparatus comprising:

a memory device including a waveform in the form of a sequence of amplitude value data arranged at a given sampling period to represent a corresponding musical tone;

a coordinate detecting device electrically coupled to at least said memory device having a length adapted to receive the touch action, detect a point of the touch action along the length, and output a positional value corresponding to the detected point of the touch action, wherein the touch action determines the reading of the waveform from the memory device; and a processor electrically coupled to at least said memory device and said coordinate detecting device adapted to periodically retrieve the positional value outputted from the coordinate detecting device to monitor the touch action, and to variably determine each reading address according to the retrieved ones of the positional values and successively read out the waveform from the memory device according to each determined reading address so as to reproduce the corresponding musical tone with the scratch effect, wherein the processor differentially processes the periodically retrieved positional values to compute a velocity of the touch action, and wherein the processor determines a variable number according to the velocity of the touch action and accumulates the variable number to a preceding reading address to determine a succeeding reading address.

61. A music apparatus for reproducing a musical tone by reading out a corresponding waveform according to a variable reading address so as to introduce a scratch effect into the reproduced musical tone in response to touch action, the music apparatus comprising:

a sound input/output device adapted to receive a waveform from an external source continually and to provide an output for the waveform;

a memory device electrically coupled to at least said sound input/output device including the waveform received therefrom in the form of a sequence of amplitude value data arranged at a given sampling period to represent a corresponding musical tone;

a coordinate detecting device electrically coupled to at least said memory device having a length to receive the touch action adapted to detect a point of the touch action along the length and output a positional value corresponding to the detected point of the touch action, wherein the touch action determines the reading of the waveform from the memory device; and a processor electrically coupled to at least said sound input/output device, said memory device and said coordinate detecting device, the processor adapted to periodically retrieve the positional value outputted from the coordinate detecting device to monitor the touch action, the processor adapted to generate an address according to the retrieved positional value and successively read out the waveform from the memory device according to the address, the processor also adapted to reproduce a musical tone according to the waveform, wherein when the touch action is not detected by the coordinate detecting device, the memory device continues to store the inputted waveform and the processor reproduces the musical tone corresponding to the inputted waveform without the scratch effect, and when the touch action is detected by the coordinate detecting device, the memory device suspends storing of the waveform and the processor reproduces the musical tone corresponding to the waveform read out with the scratch effect.

* * * * *